US006138904A

United States Patent [19]

Baird et al.

[11] Patent Number: 6,138,904

[45] **Date of Patent: *Oct. 31, 2000**

[54] THREE-PIECE CONTAINER

[75] Inventors: William J. Baird, Indianapolis; Mike Goetz, Brownsburg, both of Ind.

[73] Assignee: Inland Paperboard and Packaging Inc., Indianapolis, Ind.

[ * ] Notice: This patent issued on a continued prosecution application filed under 37 CFR 1.53(d), and is subject to the twenty year patent term provisions of 35 U.S.C. 154(a)(2).

[21] Appl. No.: 08/964,936

[22] Filed: Nov. 5, 1997

Related U.S. Application Data

[60] Provisional application No. 60/058,339, Sep. 10, 1997.

[51] Int. Cl.[7] ..... B65D 5/00

[52] U.S. Cl. ..... 229/149; 229/149; 229/919; 229/915; 229/190; 229/122.24; 229/199; 229/178

[58] Field of Search ..... 229/166, 149, 229/171, 919, 915, 190, 122.24, 199, 122.32, 178, 122.23, 122.26

[56] References Cited

U.S. PATENT DOCUMENTS

| | | | |
|---|---|---|---|
| 2,401,742 | 6/1946 | Bentham | 229/122.24 X |
| 2,409,673 | 10/1946 | Glasscoff, Jr. et al. | 229/122.24 |
| 2,483,174 | 9/1949 | Belsinger | 229/914 |
| 2,682,362 | 6/1954 | Larson et al. | 229/914 X |
| 2,727,675 | 12/1955 | Mairs et al. | 229/122.24 |
| 2,965,279 | 12/1960 | Campbell | 229/914 X |
| 3,008,625 | 11/1961 | Cook | 229/117.16 X |
| 3,157,346 | 11/1964 | Hamilton | 229/122.23 X |
| 3,184,139 | 5/1965 | Conescu | 229/122.24 |
| 4,134,533 | 1/1979 | Heavner | 229/914 |
| 4,257,550 | 3/1981 | Frohlicher . | |
| 4,291,830 | 9/1981 | Sorensen . | |
| 4,304,351 | 12/1981 | Stollberg . | |
| 4,347,968 | 9/1982 | Cornell et al. . | |
| 4,389,013 | 6/1983 | Hall et al. . | |
| 4,497,408 | 2/1985 | Jes . | |
| 4,770,339 | 9/1988 | Weimer . | |
| 4,884,739 | 12/1989 | Nederveld . | |
| 4,911,355 | 3/1990 | Bannister . | |
| 5,263,636 | 11/1993 | Aure | 229/199 |
| 5,335,844 | 8/1994 | Young . | |
| 5,361,974 | 11/1994 | Earl et al. . | |
| 5,458,283 | 10/1995 | Southwell et al. . | |

*Primary Examiner*—Stephen P. Garbe
*Assistant Examiner*—Tri M. Mai
*Attorney, Agent, or Firm*—Barnes & Thornburg

[57] ABSTRACT

A container comprising a body including a floor having two sides and two ends, a front side wall appended to the floor along one side of the floor, a rear side wall appended to the floor along a second side of the floor to lie opposite the front side wall, first and second end panel support flaps appended to the front side wall, third and fourth end panel support flaps appended to the rear side wall, right and left end flaps appended to the floor at each end respectively, and first and second tab receiving apertures extending through the floor adjacent the points of appending of the first and second end panel support flaps respectively, a left-side end panel separately formed from a material unconnected to the body and positioned to lie at one end of the floor between the front and rear side walls and formed to include a left-side pocket receiving the first and third end panel support flaps therein and having at least one stacking tab insertable into the first tab receiving aperture, and a right-side end panel separately formed from a material unconnected to the body and positioned to lie at an opposite end of the floor between the front and rear side walls and formed Lo include a right-side pocket receiving the second and fourth end panel support flaps therein and having at least one tab insertable into the second aperture.

66 Claims, 17 Drawing Sheets

10
128
116
118
128
126
17
114
16
86
82
14
124
112
94
63
78
118
95
77
110
62
114
122
64
72
70
84
115
120
38
79
22
24
36
34
82
42
40
81
80
58
43
44
20
68
67
88
61
32
40
66
30
28
57
15
52
38
92
50
48
26
94
95
46
114
18
115
120
122
47
19
115
110
59
60
88
118
90
112
114
118
116
124
126
128
128

10
16
128
128
126
114
118
112
82
62
14
22
70
42
34
82
40
41
20
38
30
88
38
41
40
66
50
114
18
26
46
112
118
116
118
88
126
128
128

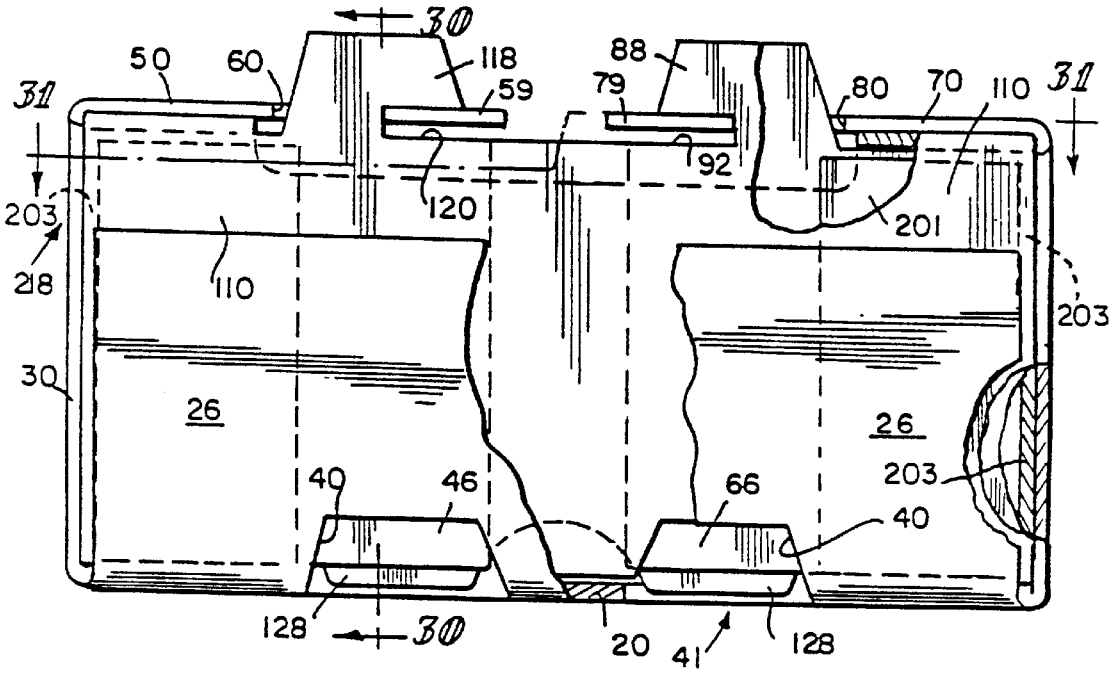
FIG. 29
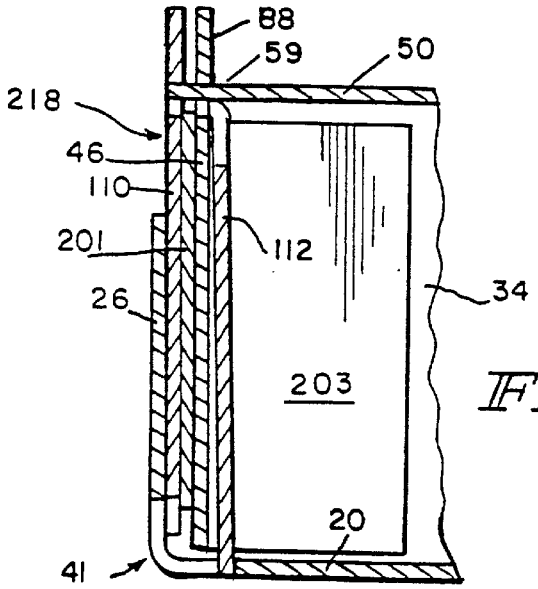
FIG. 30
FIG. 31
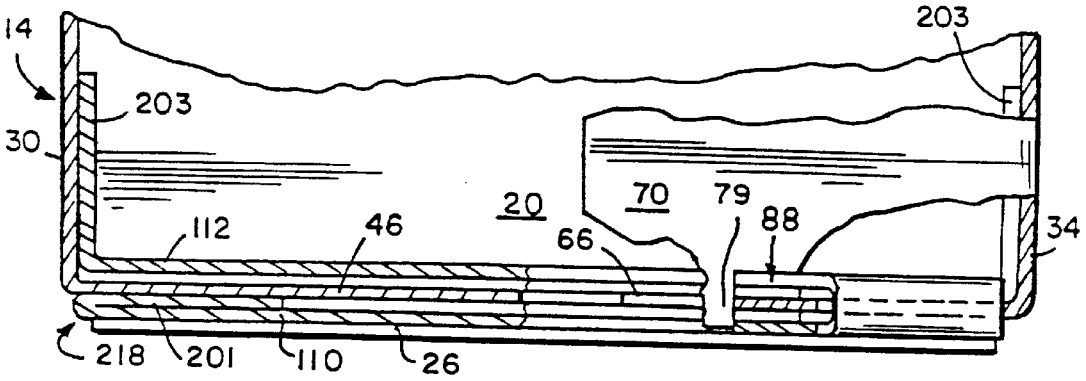

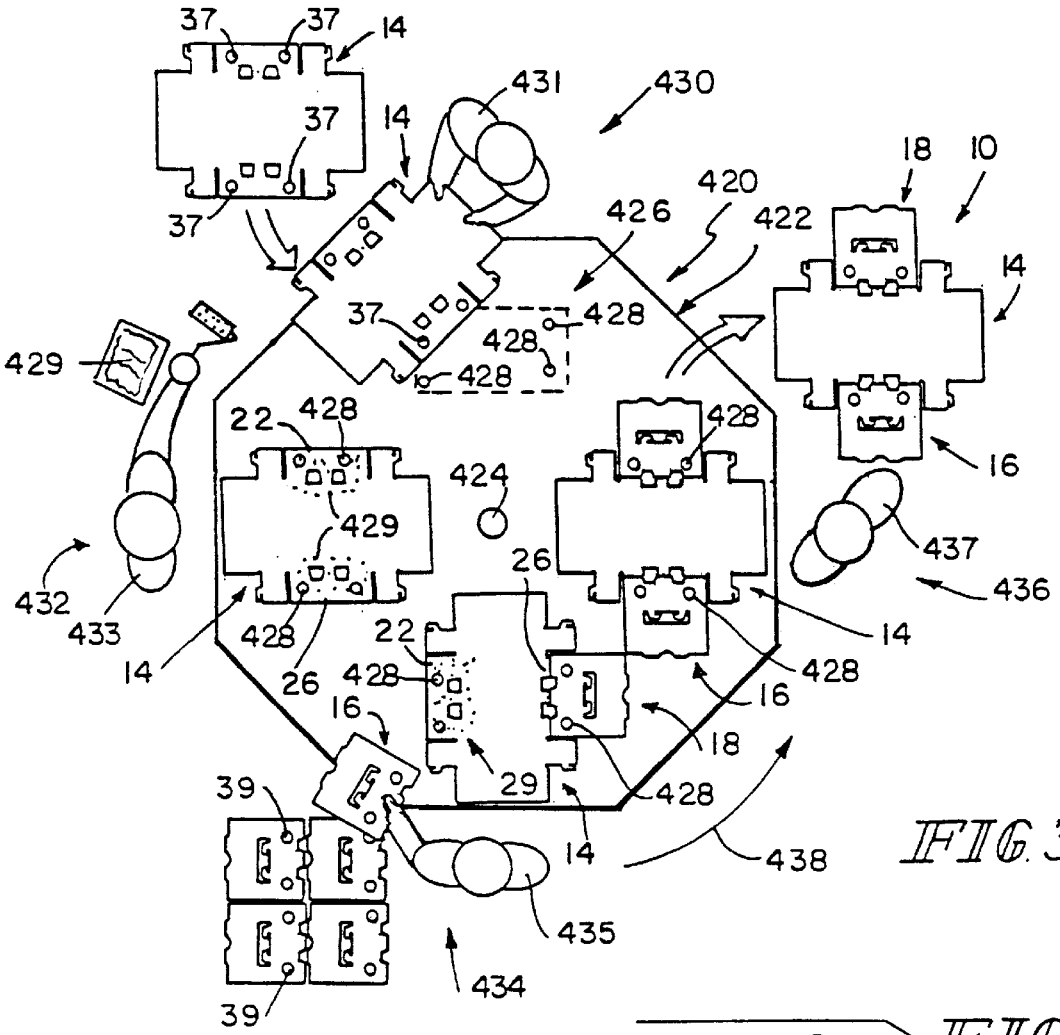
FIG. 32
FIG. 33
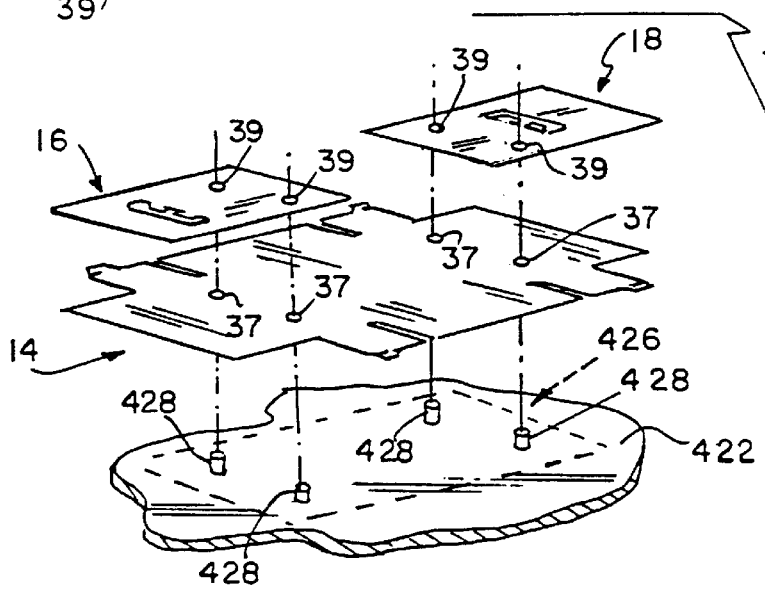

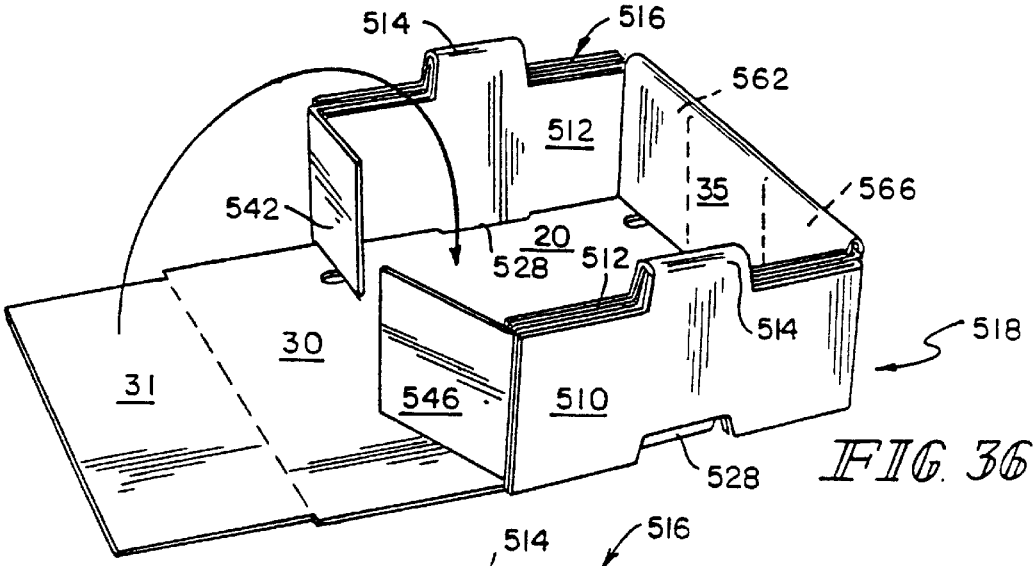
FIG. 36
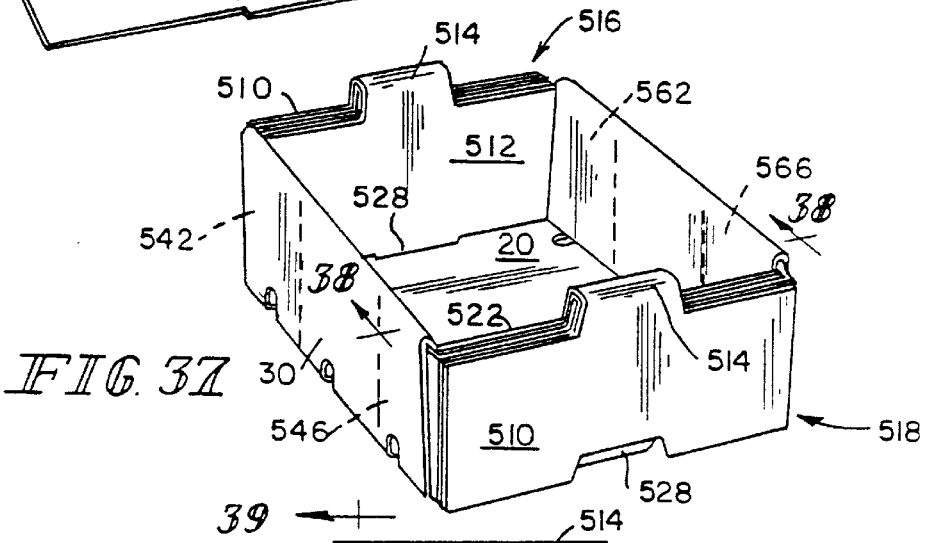
FIG. 37
FIG. 38
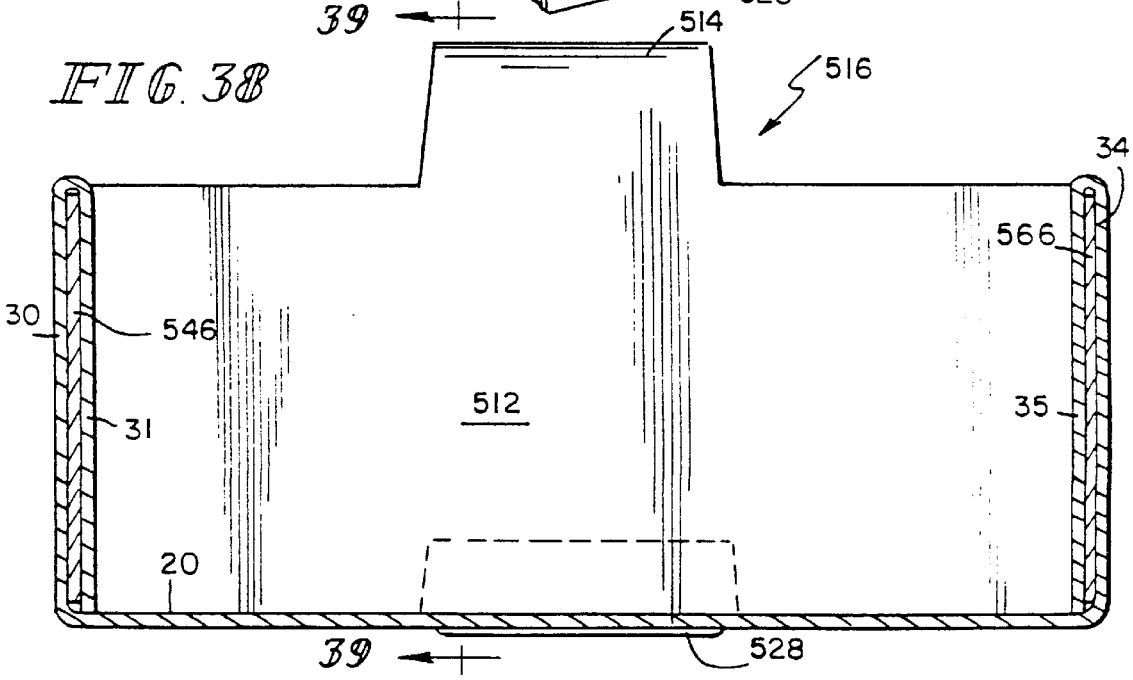

THREE-PIECE CONTAINER

This application claims the benefit of U.S. Provisional No. 60/058,339 filed Sep. 10, 1997.

The present invention relates to collapsible containers, and particularly to collapsible containers made of paperboard. More particularly, the present invention relates to a three-piece container made of corrugated material that is sturdy and suitable for holding agricultural produce.

Various fruits and vegetables frequently are shipped from growing fields to distribution centers in produce boxes or trays made of wood or other materials. It is customary in many regions of the world to assemble and fill boxes in the field rather than transporting loads of harvested fruits and vegetables to a central packing station. Conventional multi-piece, field-pack, corrugated boxes are often hard to assemble in the field and wooden boxes and trays cannot be collapsed easily for shipment to the field. A container made of paperboard that is suitable for containing agricultural produce and that can be hand-assembled easily in the field and later collapsed easily for disposal or reuse would be welcomed by growers, packers, and shippers of agricultural produce.

Many corrugated containers are not adapted to be assembled manually in the field or automatically at a container-assembly plant at the option of the packer. Some kinds of produce are always packed in the field and are ideally packed in field-pack containers that are assembled by hand in the field. Other kinds of produce are transportable in large batch quantities from the field to small and large central packing stations and can be packed at those stations in pre-assembled containers. A container that could be hand-assembled by packers at relatively small central packing stations and machine-assembled by packers at large, automated, central packing stations would be welcomed in the industry.

According to the present invention, a container includes a body and two end panels. Each end panel is coupled to one of two opposite ends of the body. In a first set of embodiments of the invention, the body includes end panel support flaps and each end panel is formed to define a pocket receiving end panel support flaps therein to strengthen the end panel and rigidify the container. In a second set of embodiments of the invention, the end panels include side wall support flaps and the body includes side walls formed to define a pocket receiving a side wall support flap of one end panel and a side wall support flap of the other end panel to strengthen the side walls and rigidify the container.

In preferred embodiments associated with the first set of embodiments, each end panel includes an outer panel section, an inner panel section, and a top edge section interconnecting the outer and inner panel sections and cooperating with the outer and inner panel sections to define the end panel support flap-receiving pocket therebetween. The body includes a floor, a front side wall appended to one side of the floor, a rear side wall appended to an opposite side of the floor, a left end flap appended to the one end of the floor and positioned to lie between the front and rear side walls, and a right end flap appended to an opposite end of the floor and positioned to lie between the front and rear side walls. The outer panel section of one of the end panels is coupled to either an inner or outer surface of the left end flap. The outer panel section of the other end panel is coupled to either an inner or outer surface of the right end flap.

In these first set of embodiments, first and second end panel support flaps are appended to opposite ends of the front side wall while third and fourth end panel support flaps are appended to opposite ends of the rear side wall. The outer and inner panel sections of the end panel coupled to the left end flap cooperate to define a pocket therebetween receiving the first and third end panel support flaps. The outer and inner panel sections of the end panel coupled to the right end flap cooperate to define a pocket therebetween receiving the second and fourth end panel support flaps.

In preferred embodiments associated with the second set of embodiments, the body also includes a floor, front and rear side walls, and left and right end flaps. However, in this set of embodiments, first and second side wall support flaps are appended to opposite edges of the left end flap while third and fourth side wall support flaps are appended to opposite edges of the right end flap. The front side wall and an auxiliary side wall appended to the front side wall cooperate to define a pocket therebetween receiving the first and third side wall support flaps. The rear side wall and another auxiliary side wall appended to the front side wall cooperate to define a pocket therebetween receiving the second and fourth side wall support flaps.

In accordance with the present invention, two end panels can be glued manually or automatically to a body to produce a multi-piece blank that can be folded easily by hand or machine to produce a container suitable for holding agricultural produce. In one set of designs according to the present invention, the end panels can be "wrapped" manually or automatically around support flaps to rigidify the container. In another set of designs according to the present invention, side walls can be wrapped manually or automatically around support flaps appended to the end panels to rigidity the container. The preferred embodiment of a multi-piece container in accordance with the present invention includes three pieces.

The body and both end panels are adapted to be mounted on jigs situated on a rotating or advancing conveyor to expedite assembly of the containers. Such a conveyor can be operated manually by workers at small, non-automated central packing stations or operated automatically in combination with other container-manufacturing equipment at larger, automated central packing stations.

Additional features and advantages of the present invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 29 is an end elevation view of the right end of the container of FIG. 26 with portions broken away;

FIG. 30 is a sectional view taken along line 30—30 of FIG. 29;

FIG. 31 is a sectional view taken along line 31—31 of FIG. 29;

FIG. 32 is a diagrammatic plan view of a rotating conveyor for facilitating assembly of left-side and right-side end panels to bodies in accordance with the present invention;

FIG. 33 is a perspective view of a jig provided on the rotating conveyor of FIG. 32;

FIG. 36 is a view similar to FIG. 35 showing final placement of the folded left-side and right-side end panels, formation of a rear side wall and auxiliary rear side wall to define a pocket receiving two of the side wall support flaps, and inward pivoting movement of two more side wall support flaps toward positions for supporting a front side wall and an auxiliary front side wall;

FIG. 37 is a view similar to FIG. 36 showing a fully assembled container and showing formation of the front side wall and auxiliary front side wall to define a pocket receiving the side wall support flaps.

FIG. 38 is a sectional view taken along line 38—38 of FIG. 37; and

DETAILED DESCRIPTION OF THE DRAWINGS

Figure 1:
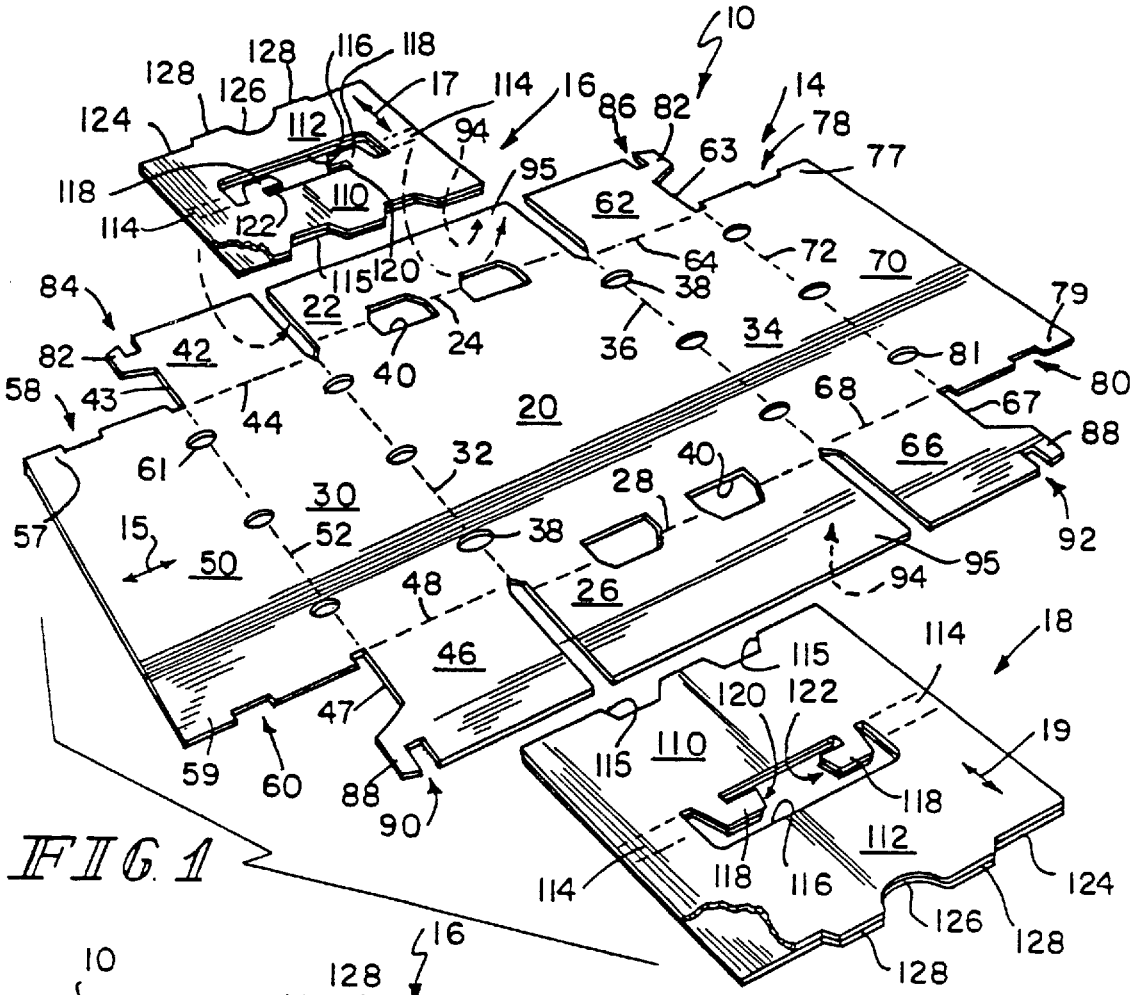
FIG. 1 is a perspective view of an unassembled three-piece container in accordance with a first embodiment of the present invention showing a body and detached left-side and right-side end panels that can be assembled to form the container shown in FIG. 7.

A blank 10 for use in making a paperboard container is shown in FIG. 1. Blank 10 can be manufactured and folded as shown in FIGS. 2–5 to form a container 12 shown in FIGS. 6 and 7. Container 12 is configured to hold various goods such as fruits, vegetables, and other agricultural products (not shown).

Blank 10 includes a body panel 14 and two end panels 16, 18. In FIG. 1, the left-side and right-side end panels 16, 18 have not yet been attached to body panel 14. During an initial stage of container assembly, the left-side and right-side end panels 16, 18 are attached (e.g., glued) to body panel 14 as shown, for example, in FIG. 2. In a preferred embodiment, body panel 14 and end panels 16, 18 are made of a paperboard such as corrugated material. Body panel 14 is made so that its fluting runs in directions 15 and end panels 16, 18 are made so that their fluting runs in directions 17, 19, respectively. Once end panels 16, 18 are coupled to body panel 14, fluting directions 17, 19 are oriented to lie in perpendicular relation to fluting direction 15 to rigidity the container 12 made from blank 10.

Each of panels 14, 16, 18 is die cut or otherwise formed to have the configuration shown in FIG. 1. It is within the scope of the present invention to vary the size and shape of panels 14, 16, 18 to produce either a rectangular, square, or other shape container 12 of any suitable length, width, and height dimension. Although end panels 16, 18 are made of two-ply construction (e.g., two layers of corrugated material) as shown in FIG. 1, it is within the scope of the present invention to make end panels 16, 18 of single-ply construction or any suitable multi-ply construction.

Body panel 14 includes a floor 20, left end flap 22 appended to floor 20 at fold line 24, an opposite right end flap 26 appended to floor 20 at fold line 28, a front wall 30 appended to floor 20 at fold line 32, and an opposite rear wall 34 appended to floor 20 at fold line 36. Vent apertures 38 are formed in floor 20, front wall 30, and rear wall 34 along fold lines 32 and 36 as shown in FIG. 1. Stacking tab-receiving apertures 40 are formed in floor 20, left end flap 22, and right end flap 26 along fold lines 24 and 28.

Body panel 14 also includes a first left end panel support flap 42 appended to front wall 30 at fold line 44 and an opposite first right end panel support flap 46 appended to front wall 30 at fold line 48. Body panel 14 further includes a first lid section 50 appended to front wall 30 at fold line 52. First lid section 50 includes two diagonal fold lines 54, 56 and two spaced-apart tab-engaging slots 58, 60. A lid tab 57 is adjacent to slot 58 and a lid tab 59 is adjacent to slot 60 as shown in FIG. 1. Vent apertures 61 are formed in front wall 30 and first lid section 50 along fold line 52 as shown in FIG. 1.

Body panel 14 also includes a second left end panel support flap 62 appended to rear wall 34 at fold line 64 and an opposite second right end panel support flap 66 appended to rear wall 34 at fold line 68. Body panel 14 further includes a second lid section 70 appended to rear wall 34 at fold line 72. Second lid section 70 includes two diagonal fold lines 74, 76 and two spaced-apart tab-engaging slots 78, 80. A lid tab 77 is adjacent to slot 78 and a lid tab 79 is adjacent to slot 80 as shown in FIG. 1. Vent apertures 81 are formed in rear wall 34 and second lid section 70 along fold line 72 as shown in FIG. 1. In certain embodiments, lid sections 50 and 70 may be excluded.

Each of first and second left end panel support flaps 42 and 62 of body panel 14 is formed to include a cantilevered inner stacking tab 82, as shown in FIG. 1. One inner stacking tab 82 is appended to edge 43 of first left end panel support flap 42 and configured to include a lid-receiving slot 84 therein. The other inner stacking tab 82 is appended to edge 63 of second left end panel support flap 62 and configured to include a lid-receiving slot 86 therein.

Each of first and second right end panel support flaps 46, 66 of body panel 14 is formed to include a cantilevered inner stacking tab 88 as shown in FIG. 1. One inner stacking tab 88 is appended to edge 47 of first right end panel support wall 46 and configured to include a lid-receiving slot 90 therein. The other inner stacking tab 88 is appended to edge 67 of second right end panel support flap 66 and configured to include a lid-receiving slot 92 therein.

Each of left-side and right-side end panels 16, 18 includes an outer panel section 110, an inner panel section 112, and a top edge section 114 interconnecting outer and inner panel sections 110, 112 as shown in FIG. 1. Top edge section 114 can have a length and width as shown or be established by material along a single fold line (not shown).

Figure 2:
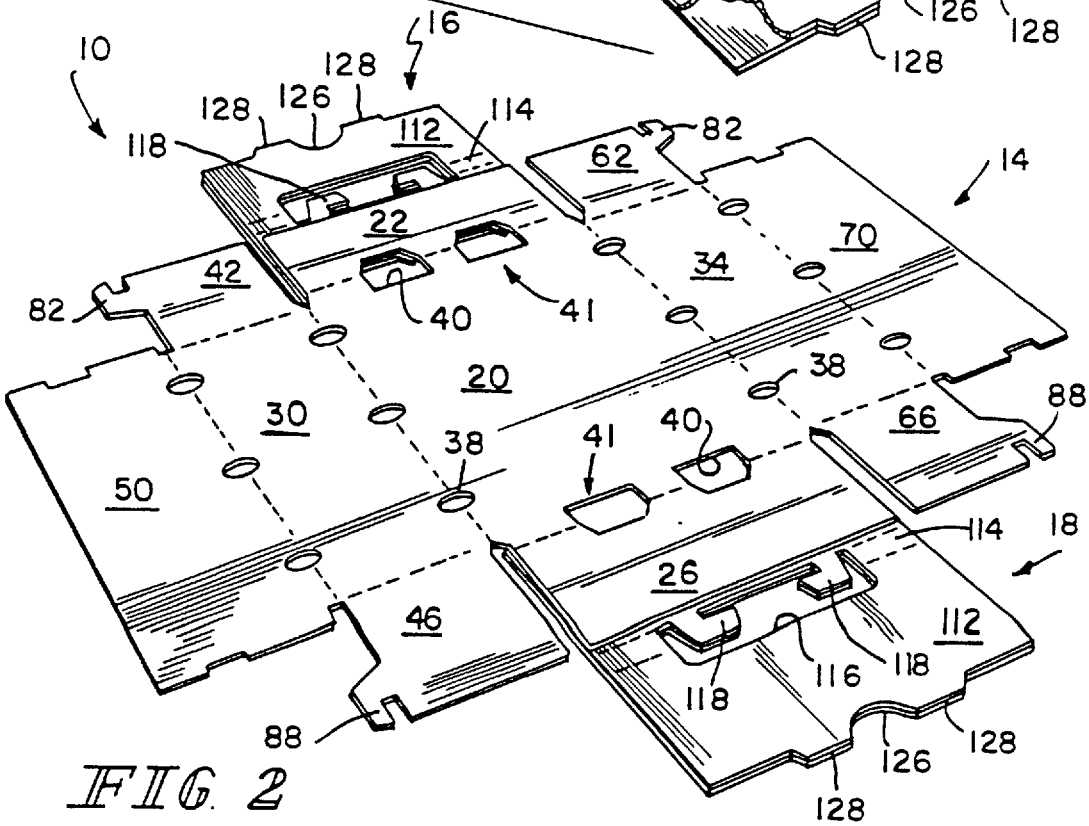
FIG. 2 is a view similar to FIG. 1 showing the left-side and right-side end panels coupled to outer surfaces of left and right end flaps included in the body at an initial stage of container assembly.

Each outer panel section 110 is formed to include cutouts 115 which cooperate and align with stacking tab-receiving apertures 40 to form openings 41 for receiving stacking tabs therein when outer panel section 110 of left-side end panel 16 is attached to an inner wall of left end flap 22 and outer panel section 110 of right-side end panel 18 is attached to an inner wall of right end flap 26 as shown, for example, in FIG. 2. Each inner panel section 112 and appendant top edge section 114 is formed to include elongated cutout 116 defining an opening (shown in FIG. 1) receiving two outer stacking tabs 118 appended to outer panel section 110. The two outer stacking tabs 118 are aligned to "face" one another in spaced-apart relation and define lid-receiving slots 120, 122 therein as shown in FIG. 1. An outer edge 124 of each of inner panel sections 112 is formed to include a finger slot 126 flanked on either side by a friction tab 128 for snugly engaging against floor 20 when the end panels 16, 18 are fully assembled as shown, for example, in FIGS. 4, 8, and 9.

In a presently preferred embodiment shown in FIGS. 1 and 8–10, each of left-side and right-side end panels 16, 18 is made of two layers of corrugated material as shown. This provides sturdy end panels 16, 18 so as to rigidity outer stacking tabs 18.

Blank 10 is manufactured as shown, for example, in FIGS. 2–5. Glue or any suitable adhesive is applied to an outer surface 94 of each of left end flap 22 and right end flap 26 of body panel 14 (outer surfaces 94 face downwardly into the paper in FIG. 1). Then outer panel section 110 of left-side end panel 16 is moved to contact the outer glue-carrying surface of left end flap 22 and outer panel section 110 of right-side end panel 18 is moved to contact the outer glue-carrying surface of the right end flap 26. Thus, left-side end panel 16 is coupled to left end flap 22 of body panel 14 at one end of floor 20 and outer panel section 110 of right-side end panel 18 is coupled to right end flap 26 at an opposite end of the body panel floor 20. Although glue or any suitable adhesive is used to couple left-side panel 16 to left end flap 22 and right-side panel 18 to right end flap 26 when container 12 is intended to hold agricultural product, staples or other suitable fasteners alternatively can be used to establish such coupling.

During manufacturing, a single blank 10 is made by gluing two end panels 16, 18 to a body panel 14. Single blanks 10 can then be shipped flat easily to destinations throughout the world and to destinations in agricultural fields. These blanks 10 can also be assembled manually or mechanically at container-assembly facilities.

Once flat blanks 10 arrive at a point of use in the field, blanks 10 can be assembled or knocked down easily by hand. The design of blanks 10 allow an end user to "hand assemble" the corrugated container 12 without the use of any machinery. As noted previously, for agricultural uses, this allows container 12 to be assembled easily in the field and for industrial uses this allows container 12 to be "collapsed" easily for either disposal or "reuse." Such a design for blank 10 eliminates the need for an end user to purchase special mechanical equipment for use in erecting or knocking down container 12. Containers 12 are adapted to be made by hand on a conveyor provided with a jig as shown, for example, in FIGS. 32 and 33. Containers 12 can also be made using fully automated container-assembling machinery at a central packing station or elsewhere.

A presently preferred embodiment of container 12 is shown in FIGS. 5–12. As shown, for example, in FIG. 7, once assembled, inner stacking tabs 82 and double-thickness outer stacking tabs 118 are aligned adjacent to one another to form two sturdy and rigidified stacking tab sets along left-side end panel 16. Likewise, inner stacking tabs 88 and another set of outer stacking tabs 118 are aligned and cooperate along right-side end panel 18 to form opposite sets of sturdy and rigidified stacking tabs. When containers 12 are stacked on top of one another, the four upstanding sets of stacking tabs shown in FIG. 7 will engage the four stacking tab-receiving openings 41 that are formed along the underside of floor 20, two of which are shown, for example, in FIGS. 7–9.

Container 12 includes left-side and right-side end panels 16, 18 provided with tall and wide outer surfaces 10 well-suited for use as printed or label-bearing surfaces. This feature will appeal to many product or produce distributors in need of shipping containers.

Figure 7:
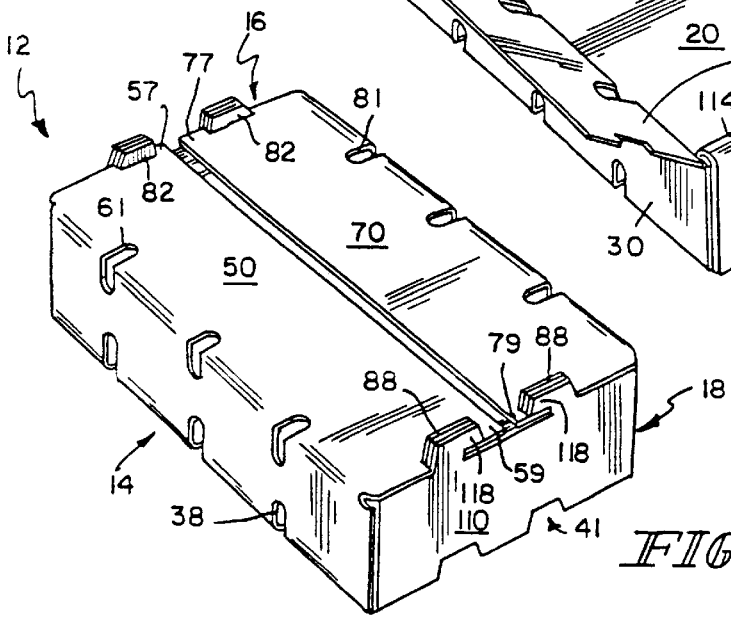
FIG. 7 is a view similar to FIG. 6 of a closed container in accordance with the first embodiment of the present invention.
Figure 8:
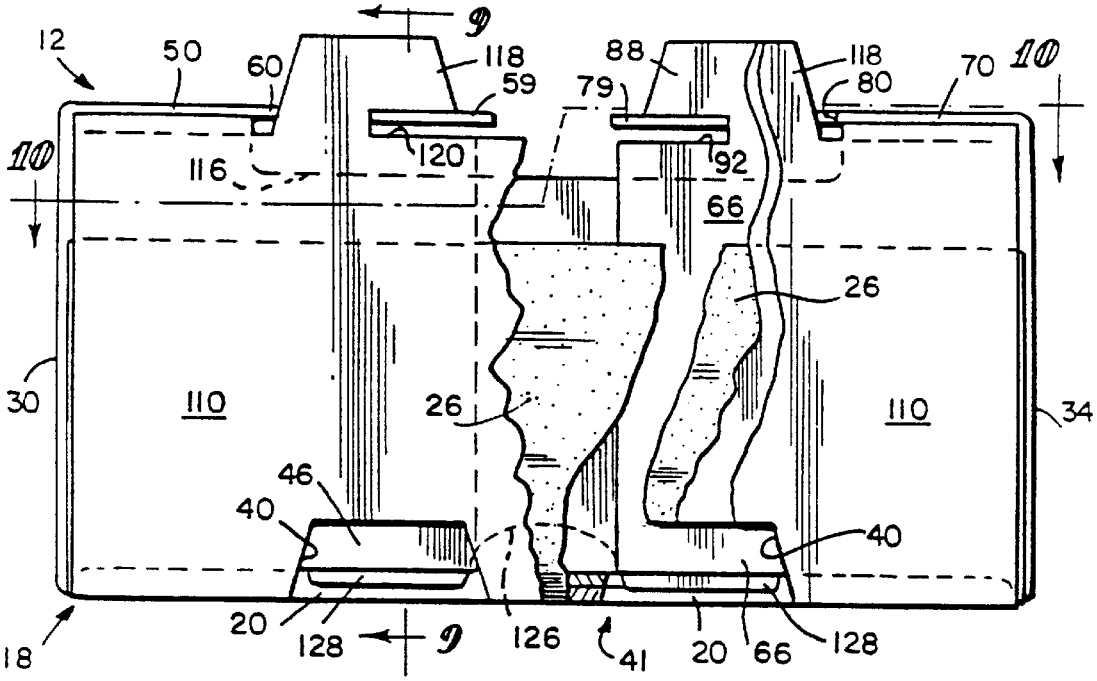
FIG. 8 is an end elevation view of the right end of the container of FIG. 7 with portions broken away.
Figure 9:
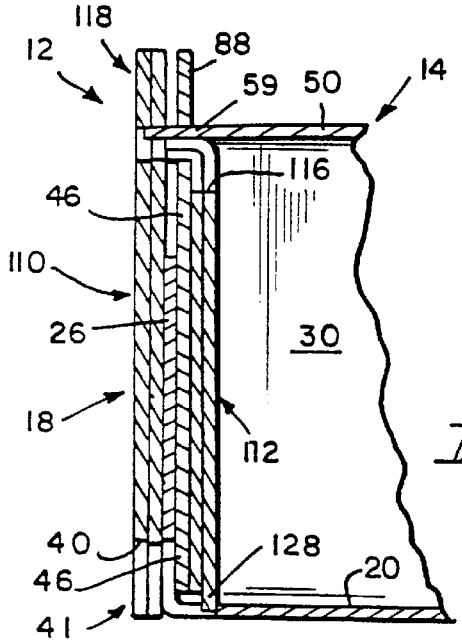
FIG. 9 is a sectional view taken along line 9—9 of FIG. 8.
Figure 10:
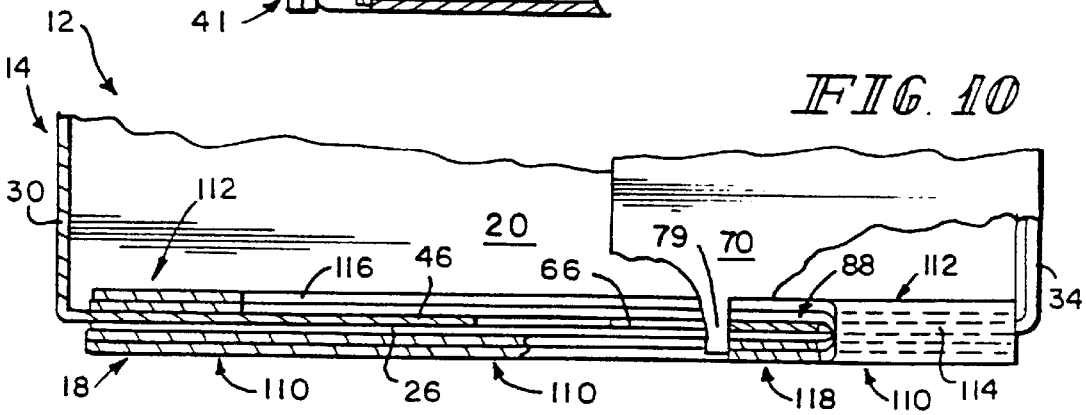
FIG. 10 is a sectional view taken along line 10—10 of FIG. 9.

Lid sections 50 and 70 are held in closed position covering a top opening formed in container 12, in part, by engagement of lid tabs 57 and 59 and 77 and 79 in slots formed in the four stacking tab sets as shown, for example, in FIGS. 7–9. As shown in FIG. 7, lid tab 57 on first lid section 50 fits into slot 84 formed in one of the stacking tab sets 82, 118 and the other lid tab 59 formed on first lid section 50 fits into slot 90 formed in another stacking tab set 88, 118 to hold first lid section 50 in its closed position. Likewise, lid tab 77 fits into slot 86 formed in one of the stacking tab sets 82, 118 and lid tab 79 on second lid section 70 fits into slot 92 formed in the other of the stacking tab sets 88, 118 to hold second lid section 70 in its closed position as shown in FIG. 7.

Figure 3:
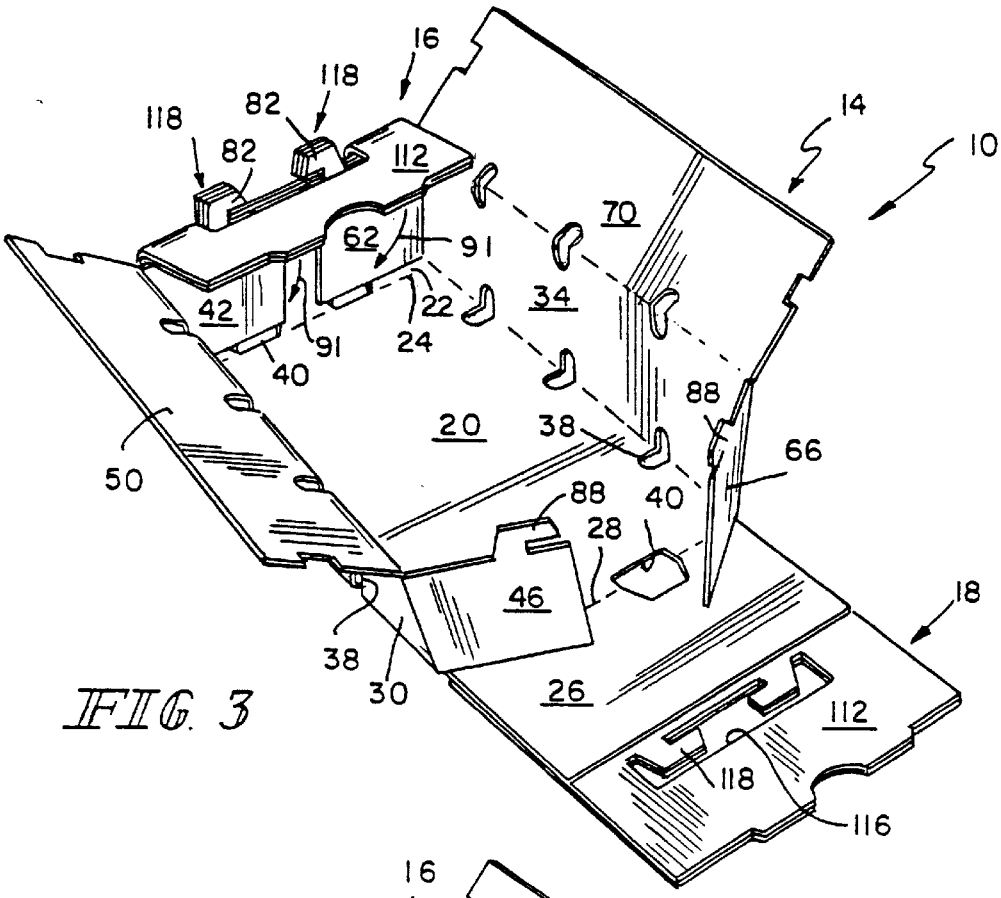
FIG. 3 is a view similar to FIG. 2 showing partial folding of a left-side end panel around two end panel support flaps included in the body and showing inward pivoting movement of two more end panel support flaps included in the body toward right-side end panel-supporting positions before the right-side end panel is folded to assume the "wrapped" position shown in FIGS. 6–10.
Figure 4:
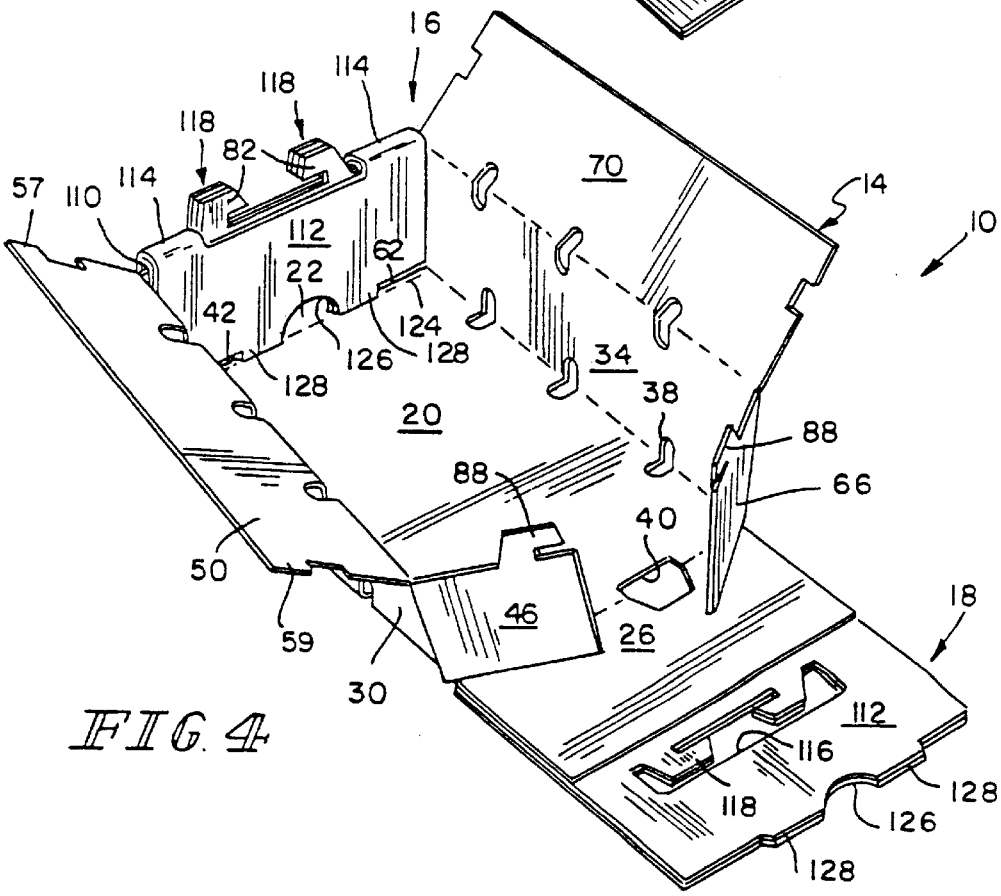
FIG. 4 is a view similar to FIG. 3 showing formation of the left-side end panel to define a pocket receiving two end panel support flaps and showing upright stacking tabs protruding from an aperture formed in the left-side end panel.
Figure 5:
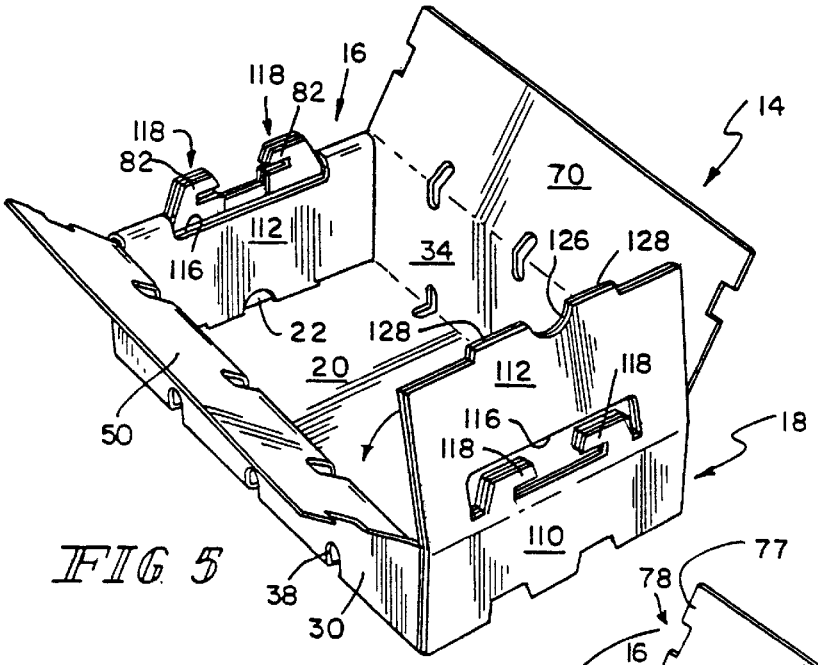
FIG. 5 is a view similar to FIG. 4 showing partial folding of the right-side end panel.
Figure 6:
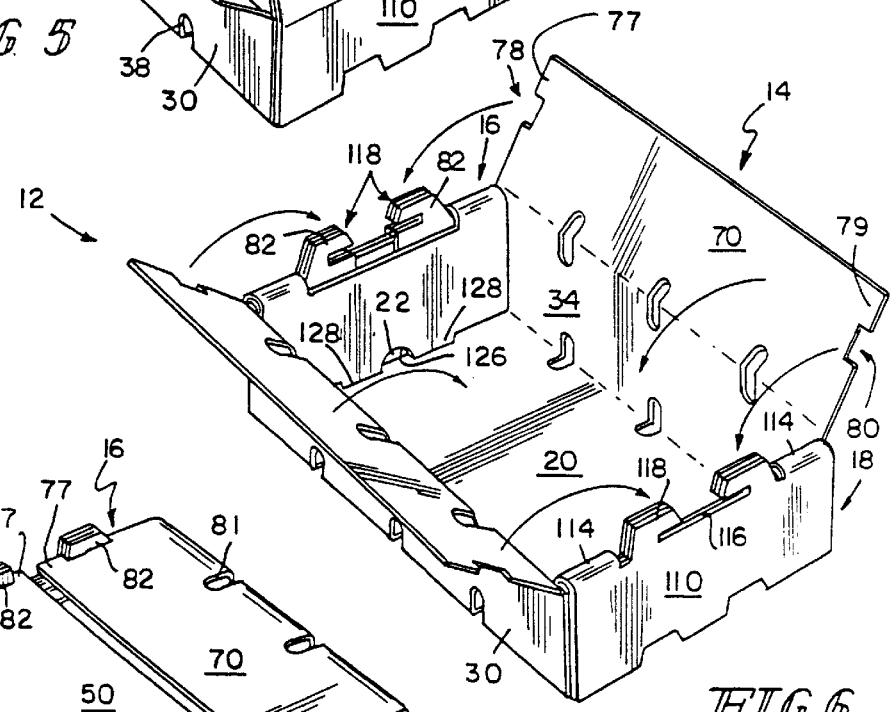
FIG. 6 is a view similar to FIG. 5 after folding of the right-side end panel and before moving first and second lid sections to assumed closed positions.

Assembly of blank 10 is shown in sequence in FIGS. 2–6. First, blank 20 comprising body panel 14 and pre-glued left-side and right-side end panels 16 and 18 is laid out flat on the ground or assembly table as shown in FIG. 2. The inner panel section of 112 is folded as shown in FIG. 3 to "wrap" around the first and second left end panel support flaps 42, 62 in folding direction 91 to pass inner stacking tabs 82 on support flaps 42, 62 through cutout 116 so that left-side end panel 16 is movable to the position shown in FIG. 4 to "sandwich" or "trap" body panel left end flap 22 between the outer and inner panel sections 110, 112 of left-side end panel 16. Right-side end panel 18 is folded in the same way as shown also in FIGS. 5 and 6. Outer stacking tabs 118 on left-side end panel 16 and outer stacking tabs 118 on right-side end panel 18 are now exposed and aligned with inner stacking tabs 82 as shown in FIGS. 6 and 7. It is within the scope of the present invention to fully or partly preform left-side end panel 16 and then place the preformed end panel 16 down onto and over end panel support flaps 42, 62 and couple end panel 16 to body panel 14 and use the same installation technique for right-side end panel 18.

Figure 11:
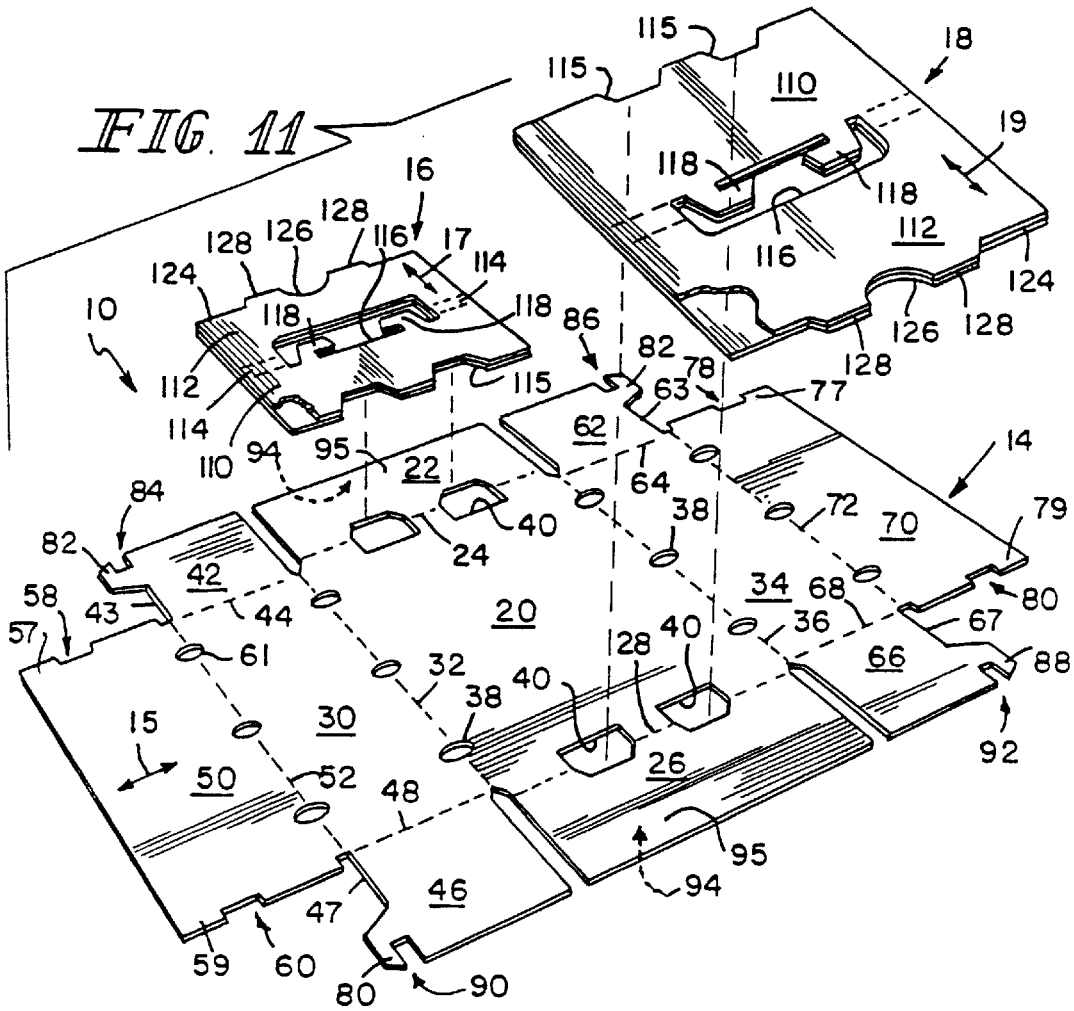
FIG. 11 is a perspective view of an unassembled three-piece container used in accordance with a second embodiment of the present invention that can be assembled to form the container shown in FIG. 14.
Figure 12:
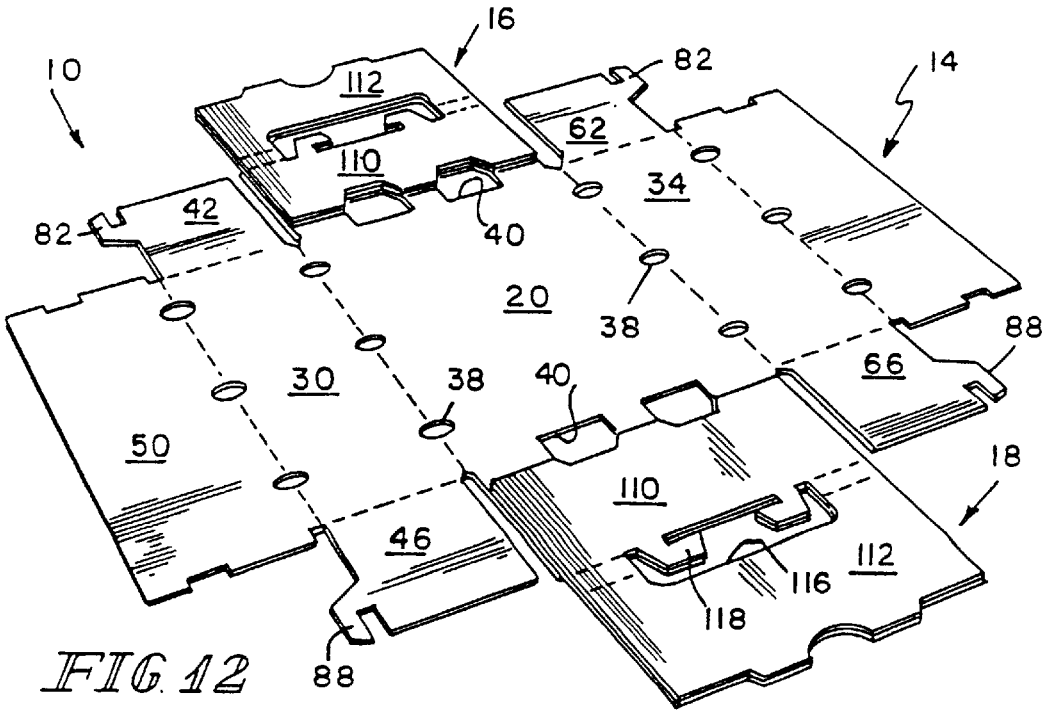
FIG. 12 is a view similar to FIG. 11 showing left-side and right-side end panels coupled to inner surfaces of left and right end flaps included in the body at an initial stage of container assembly.
Figure 13:
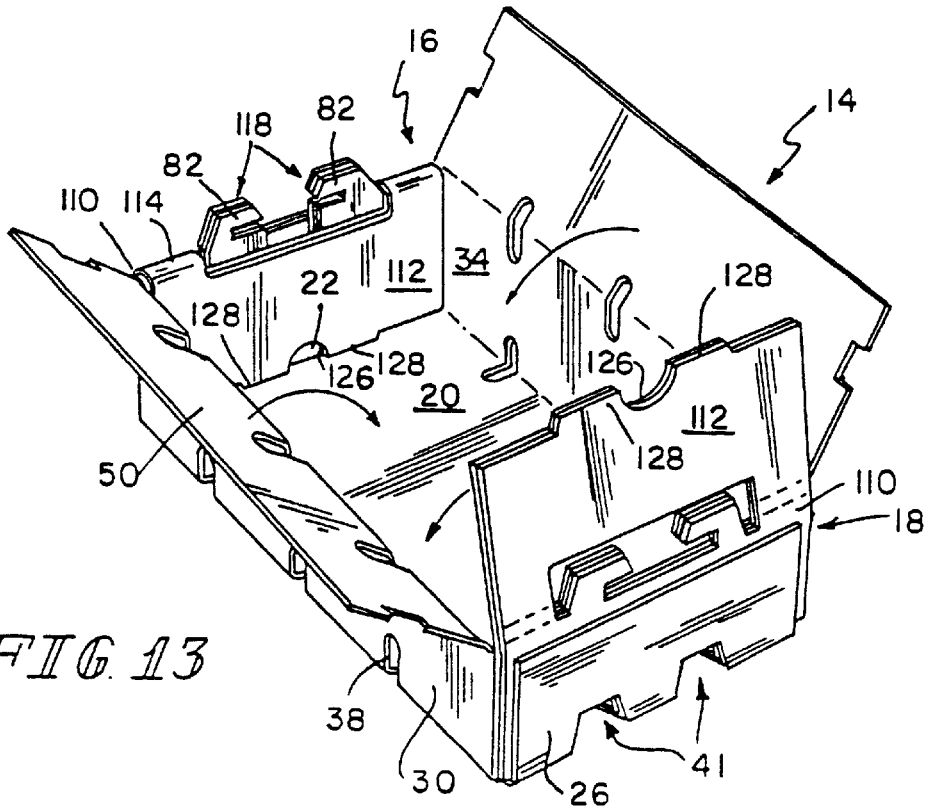
FIG. 13 is a view similar to FIG. 12 during partial assembly of the container.
Figure 14:
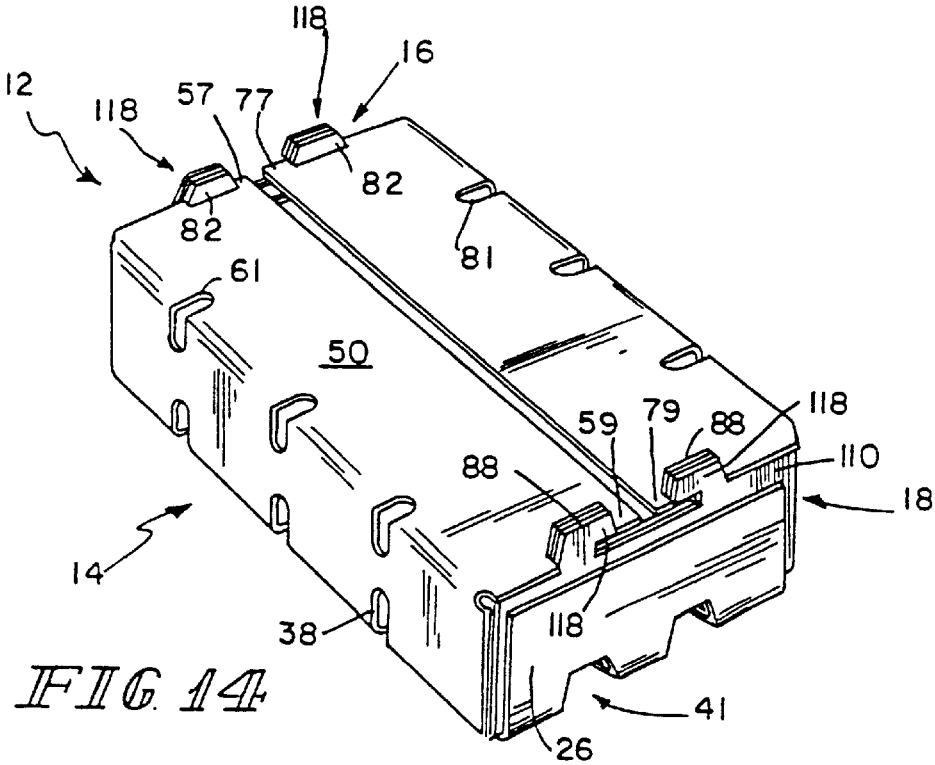
FIG. 14 is a view similar to FIG. 13 following assembly of the container and closure of two lid sections included in the container.
Figure 15:
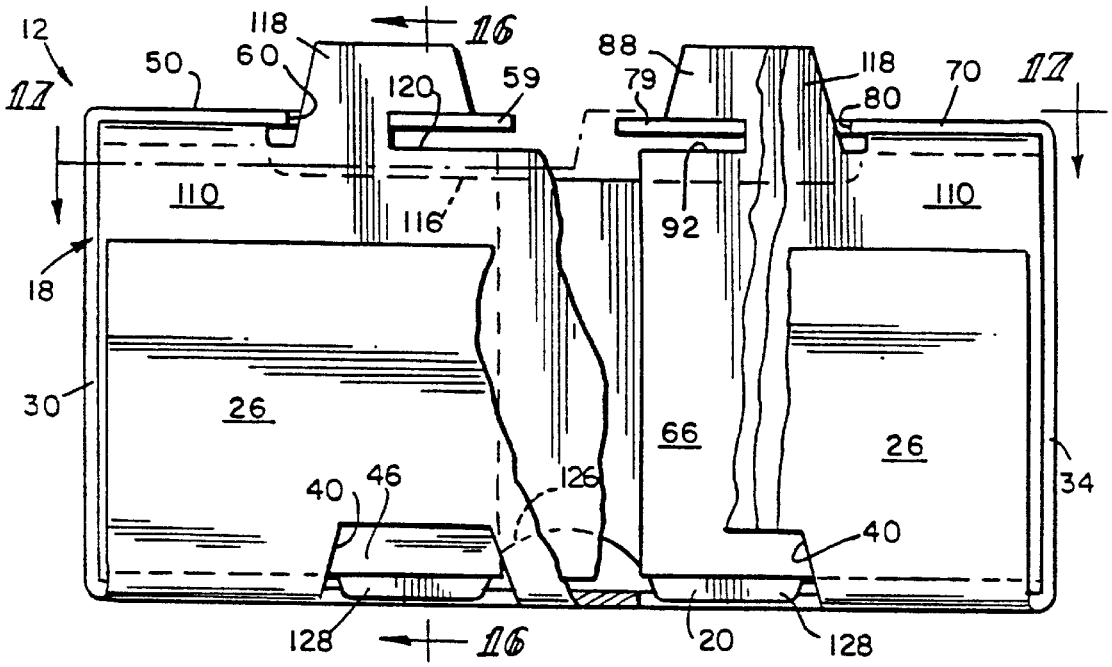
FIG. 15 is an end elevation view of the right end of the container of FIG. 14 with portions broken away.
Figure 16:
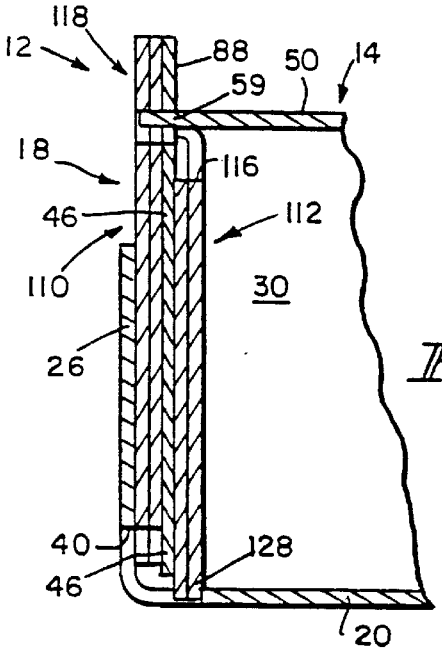
FIG. 16 is a sectional view taken along line 16—16 of FIG. 15.
Figure 17:
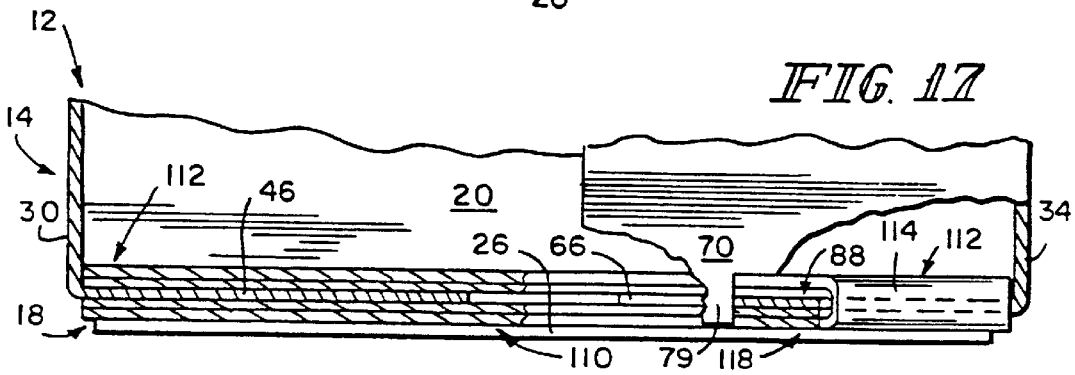
FIG. 17 is a sectional view taken along line 17—17 of FIG. 15.

A second embodiment of a container in accordance with the present invention is shown in FIGS. 11–17. In this embodiment, left-side end panel 16 is coupled to an inner surface 95 of left end flap 22 (instead of outer surface 94 as shown in FIGS. 1 and 2) and right-side end panel 18 is coupled to an inner surface 95 of right-end flap 26 (instead of outer surface 94 as shown in FIGS. 1 and 2). Such coupling to inner surfaces 95 is illustrated in FIGS. 11 and 12. In all other respects, the descriptions and accounts of the first embodiment of FIGS. 1–10 apply to this second embodiment.

A third embodiment of a container in accordance with the present invention is shown in FIGS. 18–25 and a fourth embodiment of a container in accordance with the present invention is shown in FIGS. 26–31. In these embodiments, tabbed left-side and right-side end panels 216 and 218 are coupled to body panel 14. Two of the four tabs on each of the left-side end panels 216 and 218 are folded "inwardly" to rigidity the container end walls in the third embodiment as shown, for example, in FIGS. 20–22 and are folded "outwardly" to rigidity the container side wars in the fourth embodiment as shown, for example, in FIGS. 26–28.

Figure 22:
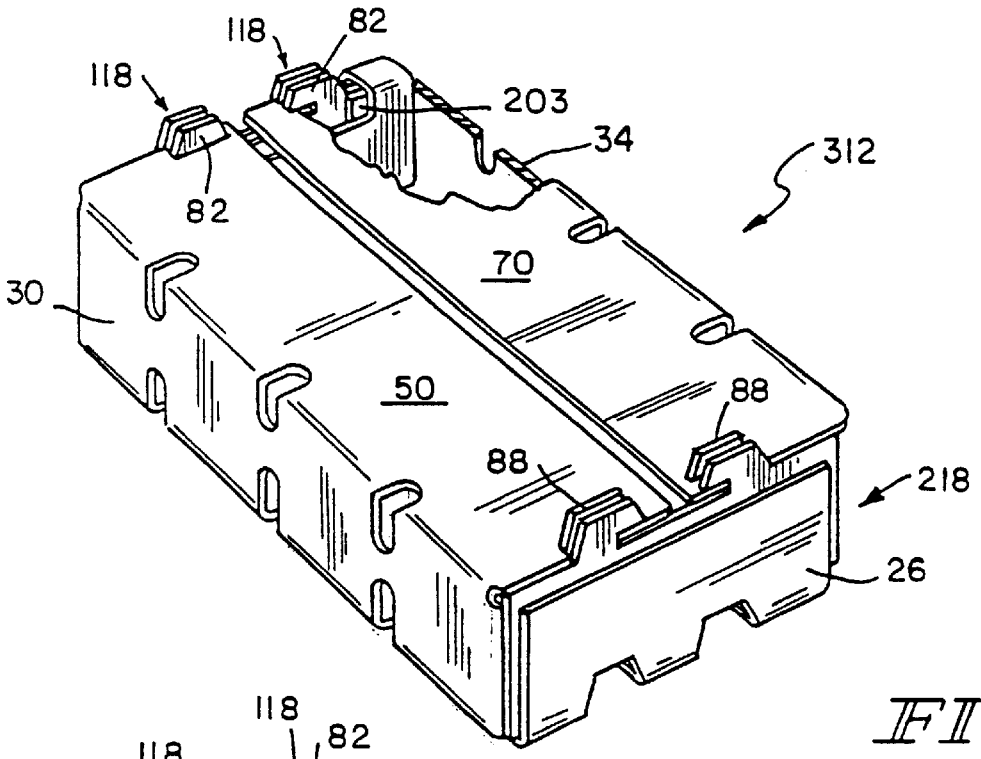
FIG. 22 is a view similar to FIG. 21 following assembly of the container and closure of two lid sections included in the container, with portions broken away, showing placement of two tabs in a pocket formed in the left end panel.
Figure 26:
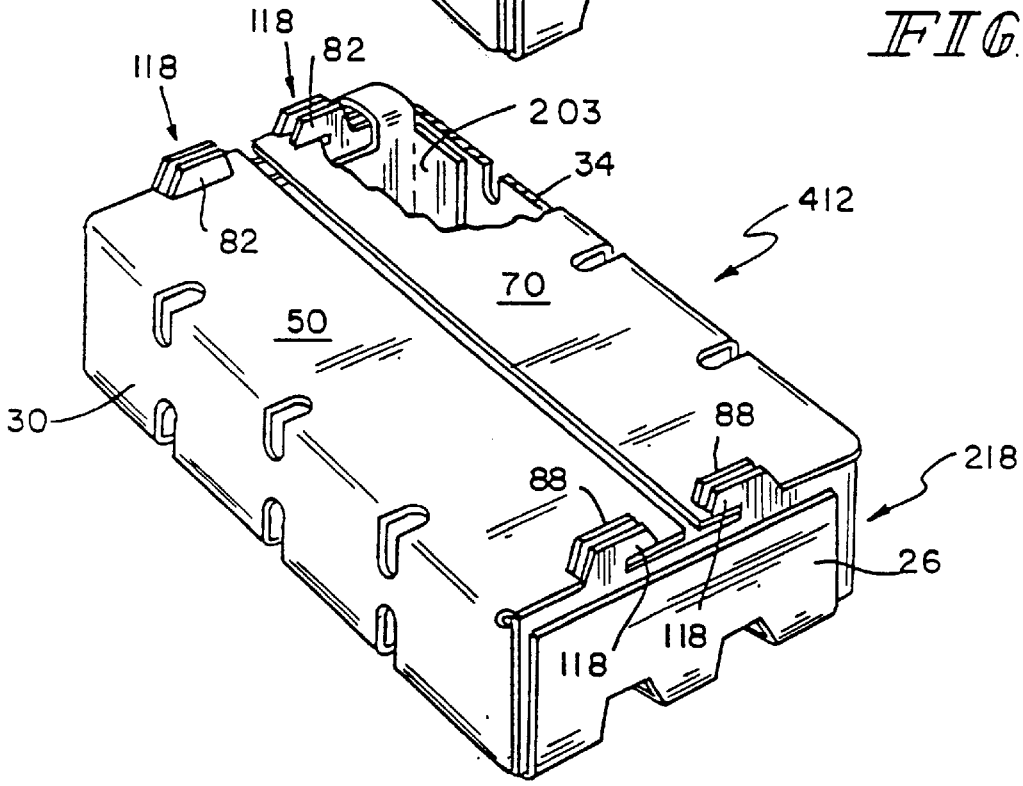
FIG. 26 is a perspective view of a three-piece container in accordance with a fourth embodiment of the present invention, with portions broken away, showing one of the tabs included in a left-side end panel positioned to engage a rear side wall (rather than positioned to lie in a pocket formed in the left-side end panel as shown, for example, in FIG. 22)
Figure 23:
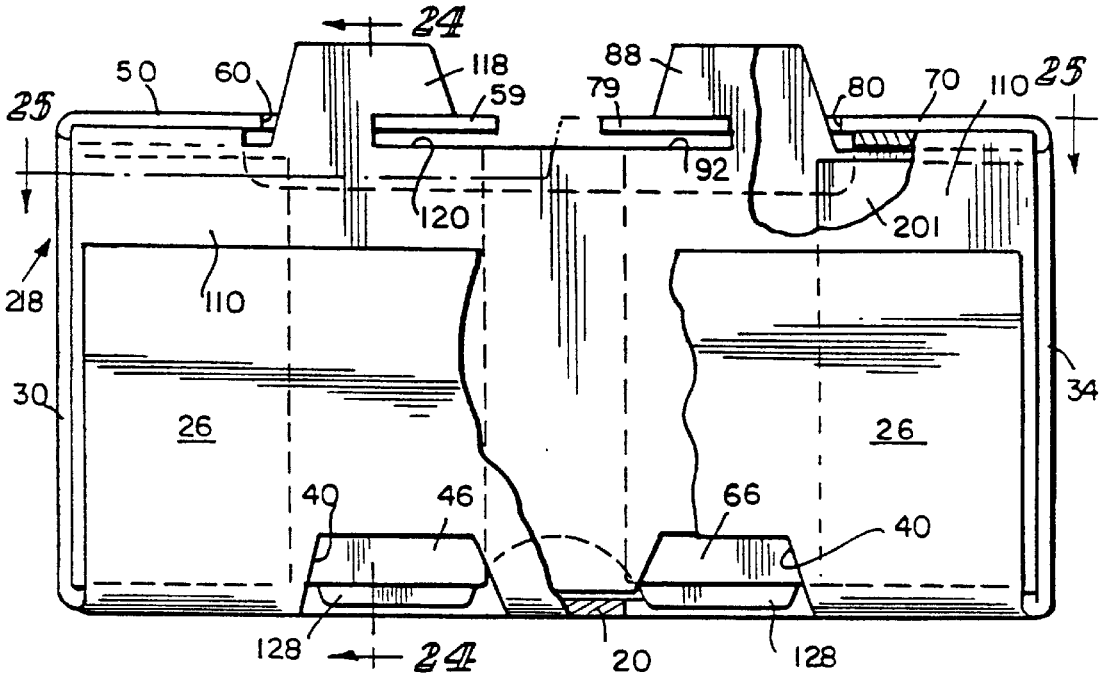
FIG. 23 is an end elevation view of the right end of the container of FIG. 22 with portions broken away.
Figure 24:
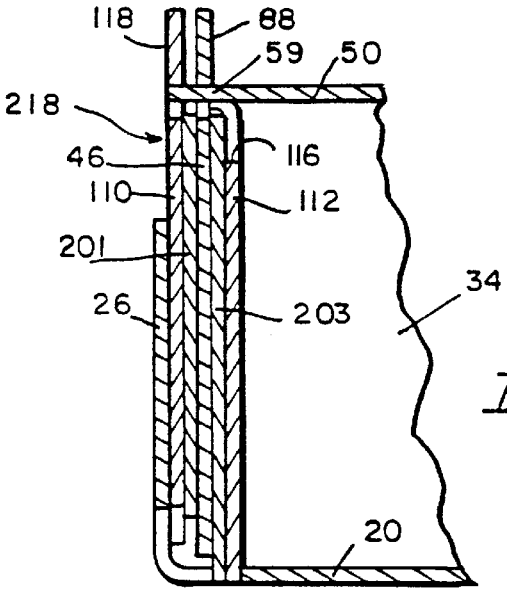
FIG. 24 is a sectional view taken along line 24—24 of FIG. 23.
Figure 25:
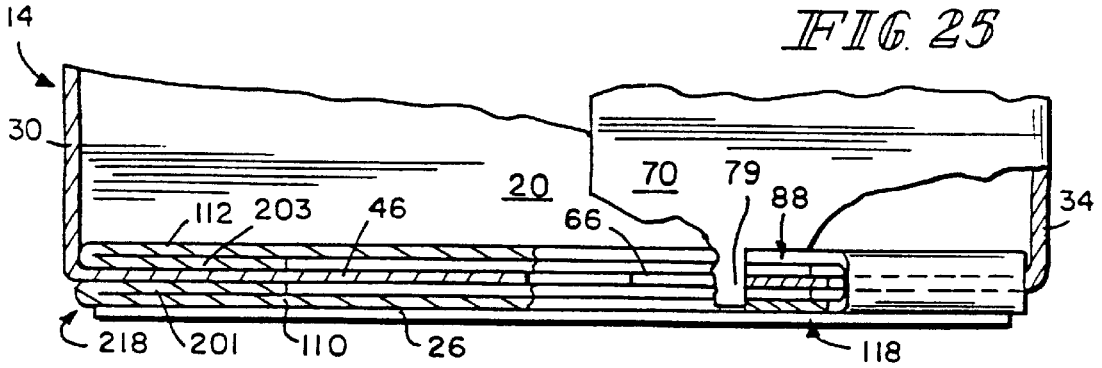
FIG. 25 is a sectional view taken along line 25—25 of FIG. 23.

Left-side end panel 216 and right-side end 218 are coupled to body panel 14 to produce a blank 210 that can be assembled to produce container 312 shown in FIG. 22 or container 412 shown in FIG. 26. Left-side end panel 16 shown in FIG. 1 is modified to include two tabs 201 appended to opposite ends of outer panel section 110 and two tabs 203 appended to opposite ends of inner panel section 112 as shown, for example, in FIG. 18 to produce left-side end panel 216. Right-side end panel 18 shown in FIG. 1 is modified in a similar way to produce right-side end panel 218. Although end panels 216, 218 are made of a single layer of corrugated material, it is within the scope of the present invention to make portions of end panels 216, 218 of multiple layers of corrugated or other suitable paperboard material.

Figure 18:
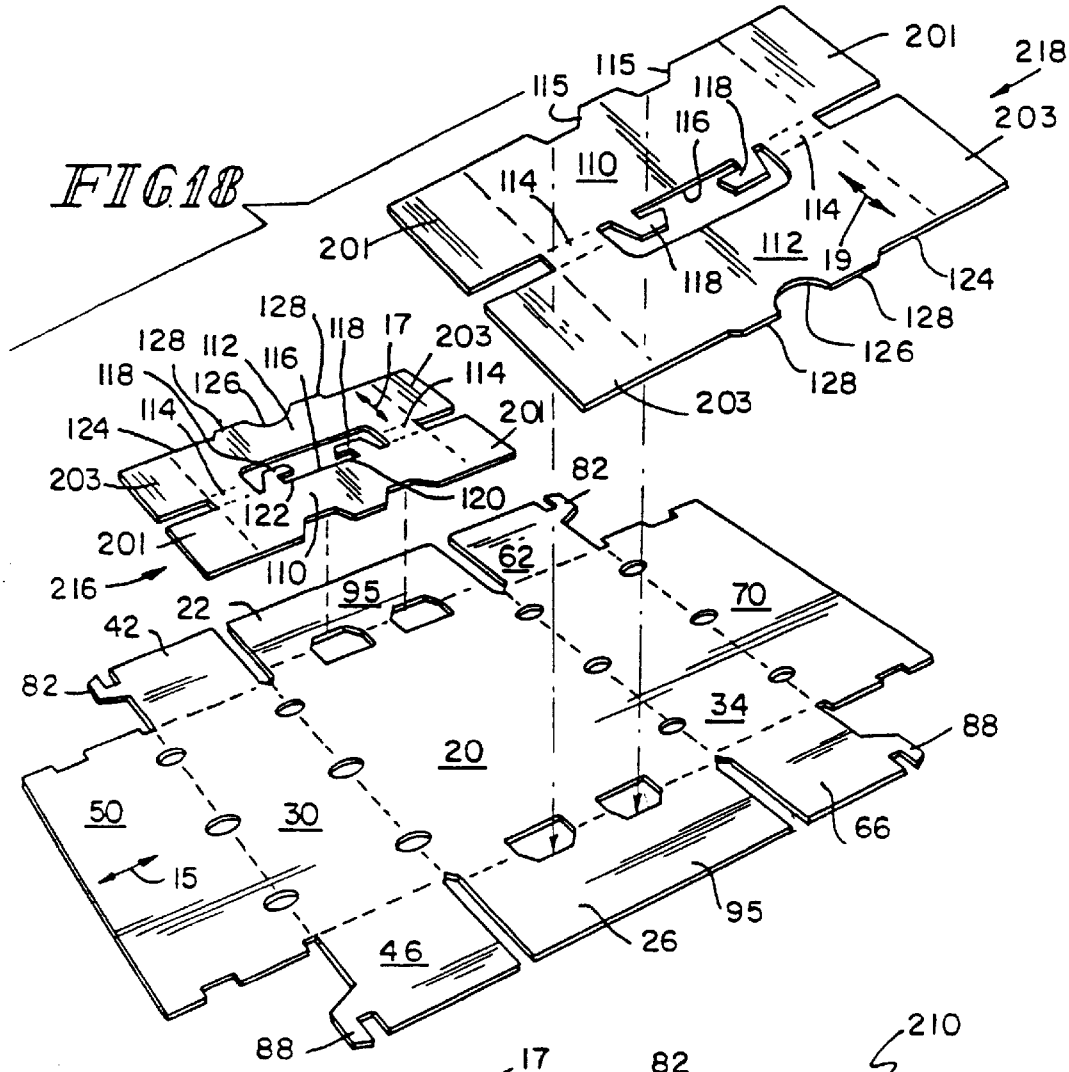
FIG. 18 is a perspective view of an unassembled three-piece container used in accordance with a third embodiment of the present invention showing a body and detached left-side and right-side end panels that can be assembled to form the container shown in FIG. 22 and showing two sets of tabs on each of the left-side and right-side end panel.
Figure 19:
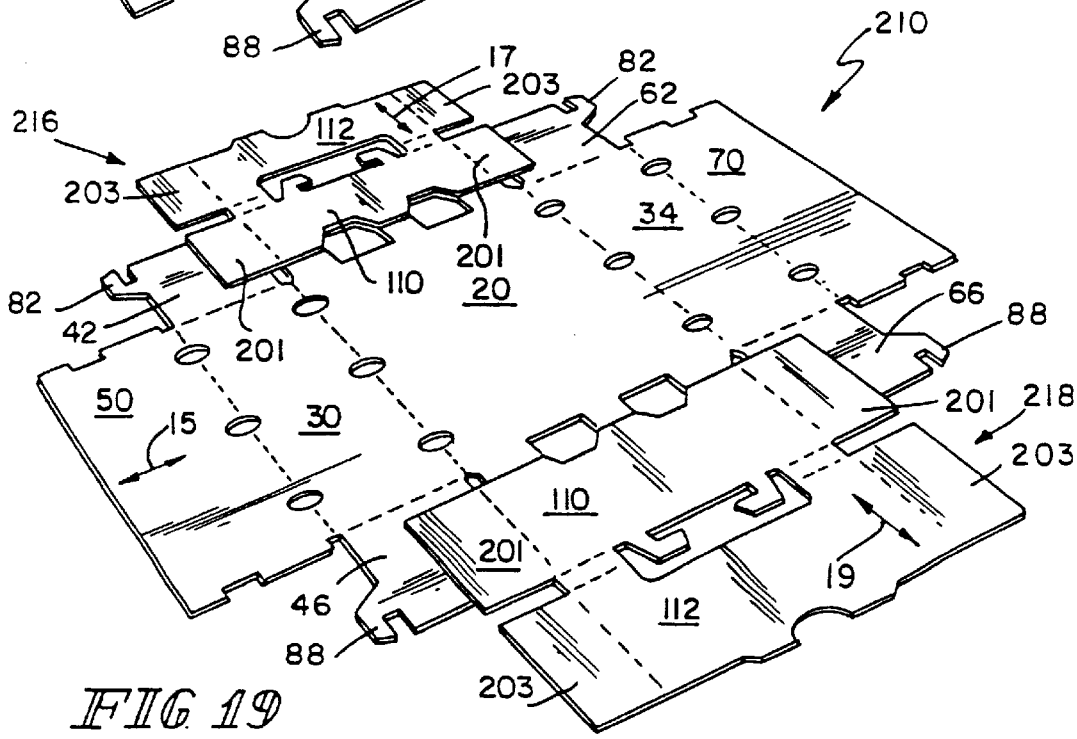
FIG. 19 is a view similar to FIG. 18 showing the tabbed left-side and right-side end panels coupled to left and right end flaps at an initial stage of container assembly.

Left-side end panel 216 is coupled to left end flap 22 as shown, for example, in FIGS. 18 and 19 to position one of tabs 201 adjacent to end panel support flap 42 and another of tabs 201 adjacent to end panel support flap 62. Likewise, right-side end panel 218 is coupled to right end flap 26 as shown, for example, in FIGS. 18 and 19 to position one of tabs 203 adjacent to end panel support flap 46 and another of tabs 201 adjacent to end panel support flap 66 to produce a blank 210 for use in accordance with the third and fourth embodiments of the present invention and shown, for example, in FIG. 19.

Figure 20:
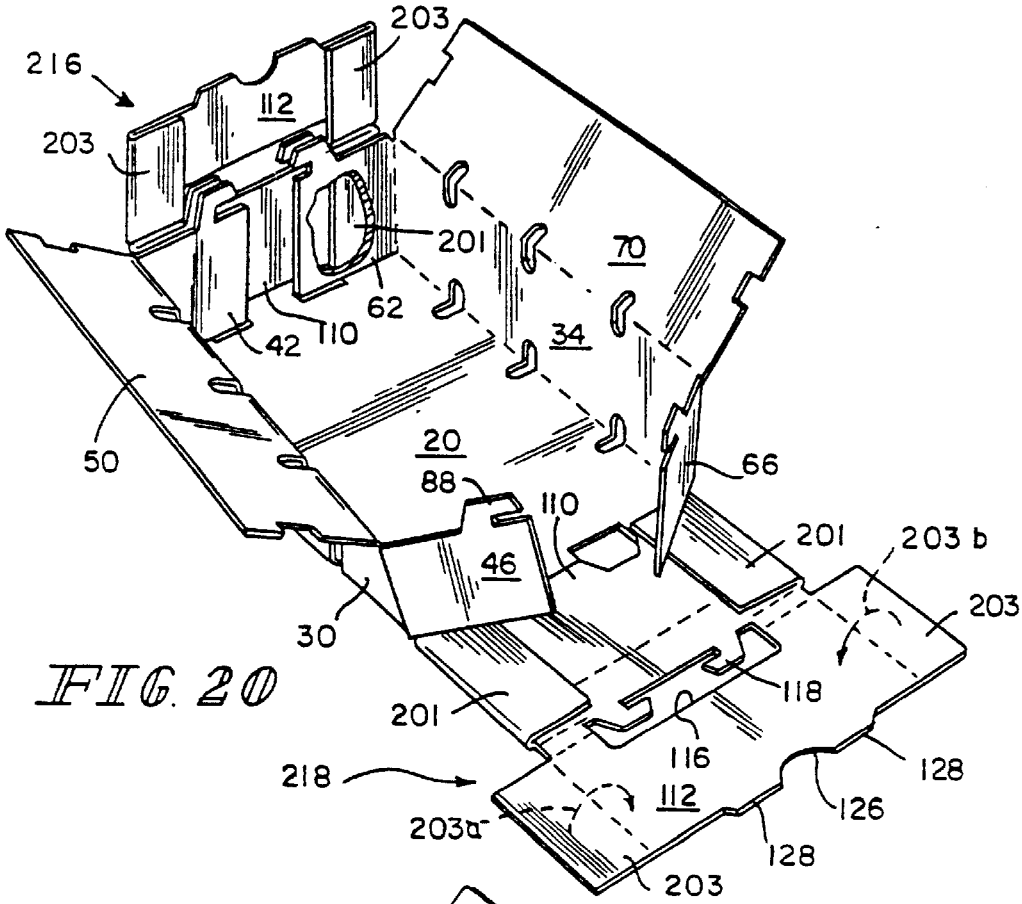
FIG. 20 is a view similar to FIG. 19 showing folding and placement of the tabs on the left-side and right-side end panels during an early stage of container assembly.
Figure 21:
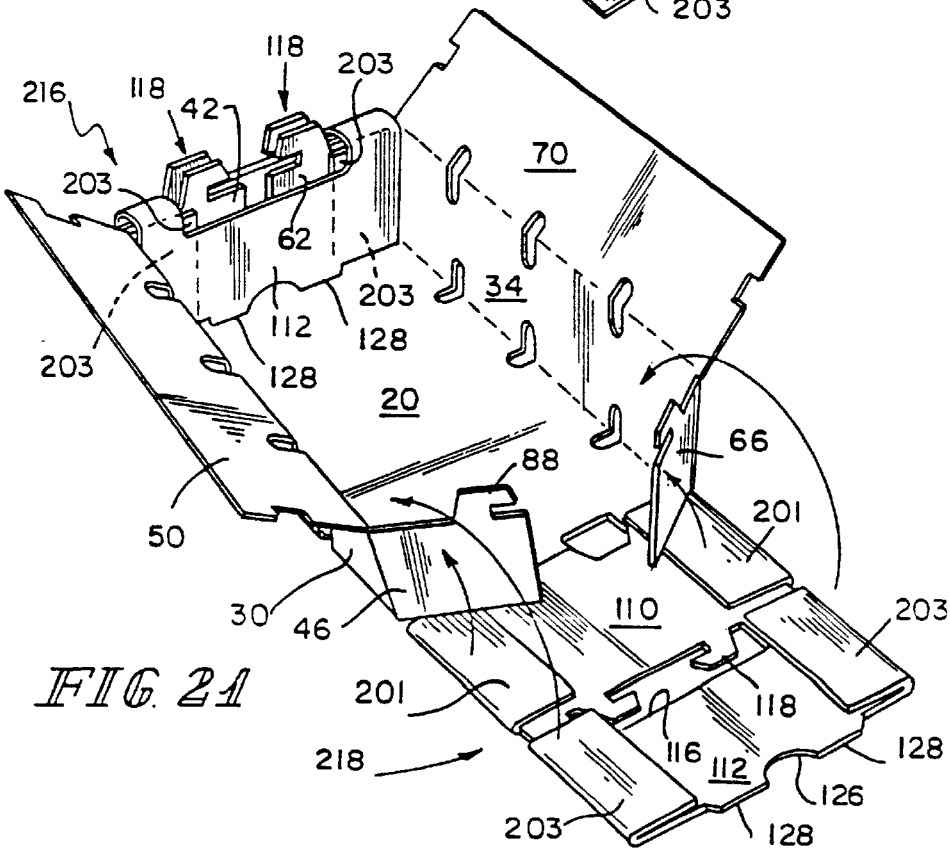
FIG. 21 is a view similar to FIG. 20 showing folding and placement of the tabs on the left-side and right-side end panels during a later stage of container assembly.

Referring now to FIGS. 20–22 and 23–25, it will be seen that tabs 201 and 203 are folded during container assembly so that when the end panels 216, 218 are folded as shown in FIGS. 20–122, the tabs 201 on left-side end panel 216 are positioned to lie between outer panel section 110 and the two left-side end panel support flaps 42 and 62 while tabs 201 on right-side end panel 218 are positioned to lie between outer panel section 110 and the two right-side end panel support flaps 46 and 66. In this third embodiment, tabs 203 are folded or tucked "inwardly" in directions 203*a* and 203*b* (see FIG. 20) so that when the end panels 216, 218 are folded as shown in FIGS. 20–22, the tabs 203 on left-side end panel 216 are positioned to lie between the two left-side end panel support flaps 42 and 62 and inner panel section 112 while tabs 203 on right-side end panel 218 are positioned to lie between the two right-side end panel support flaps 46 and 66 and inner panel section 112.

Figure 27:
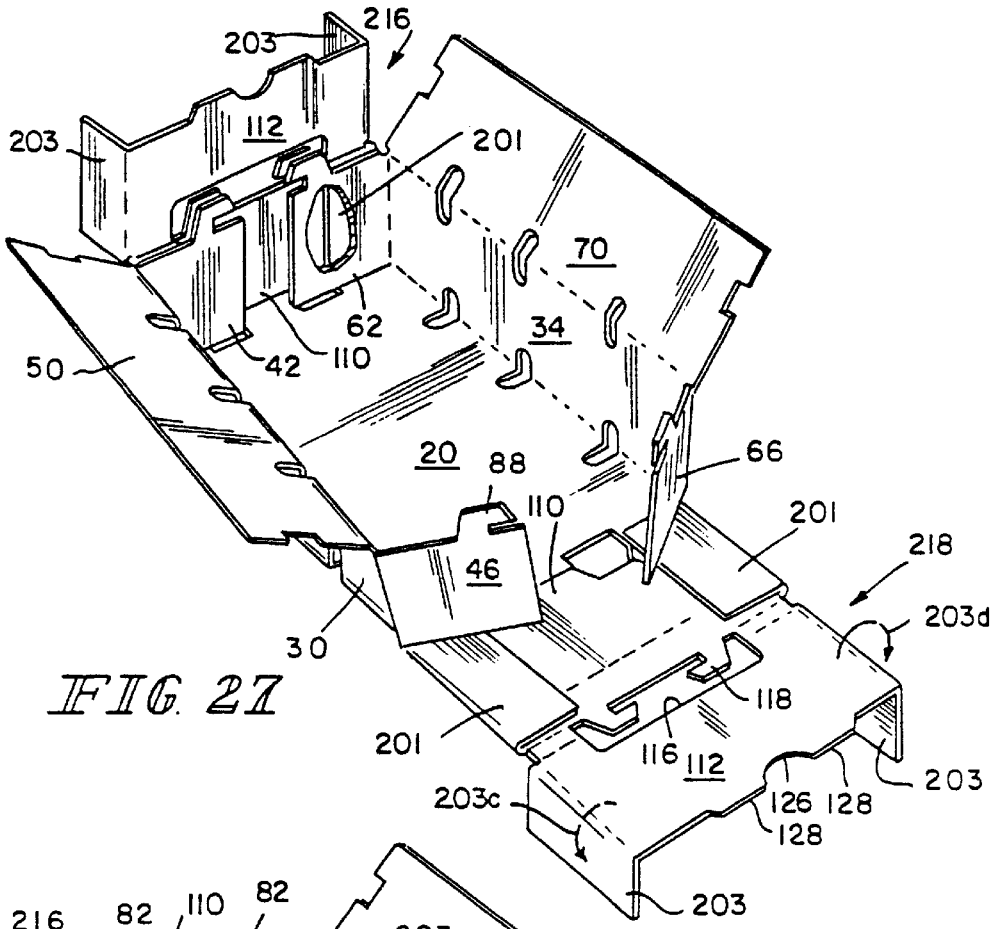
FIG. 27 is a perspective view of the container of FIG. 26 showing folding and placement of the tabs on the left-side and right-side panels during an early stage of container assembly.
Figure 28:
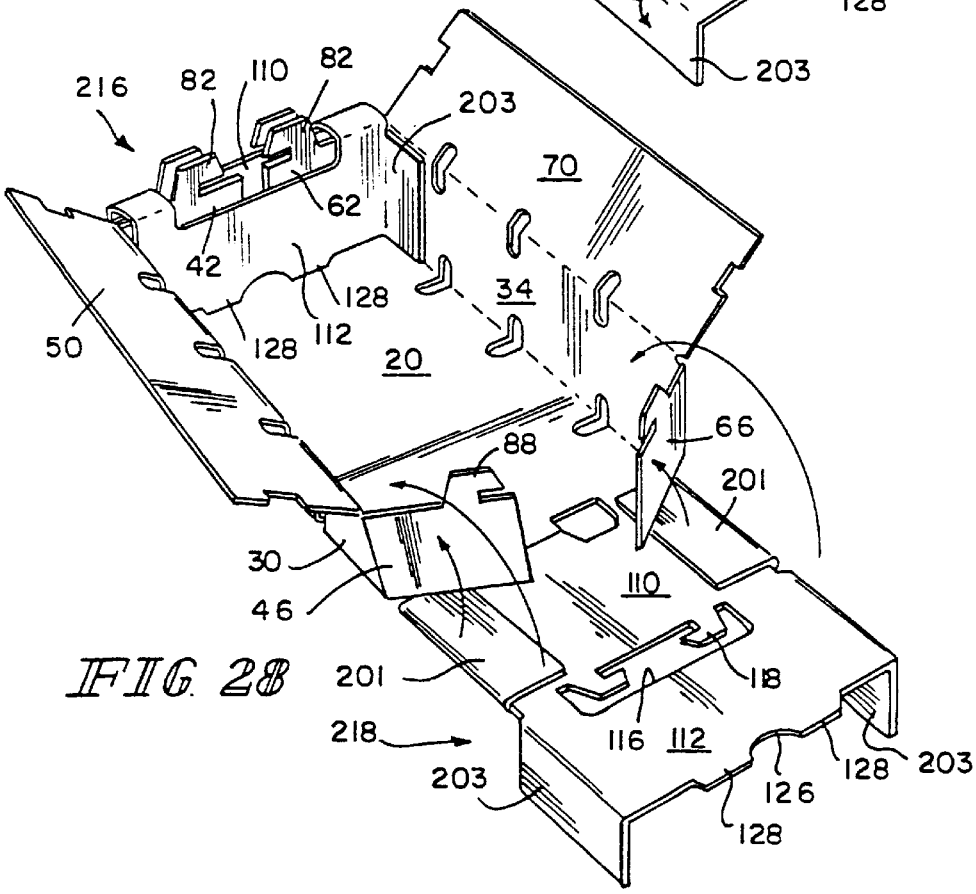
FIG. 28 is a view similar to FIG. 27 showing folding and placement of the tabs on the left-side and right-side end panels during a later stage of container assembly.

In the fourth embodiment shown in FIGS. 26–31, tabs 203 are folded "outwardly" in directions 203*c* and 203*d* (see FIG. 27) so that when end panels 216, 218 are folded as shown in FIGS. 27, 28, and 26, one tab 203 on each of left-side and right-side end panels 216 is positioned to engage and be coupled to front side wall 30 and the other tab 203 on each of left-side and right-side end panels 218 is positioned to engage and be coupled to rear side wall 34. Glue or other suitable means can be used to accomplish such coupling.

A process and apparatus for assembling multi-piece containers is disclosed herein. A conveyor and a series of container-assembly jigs on the conveyor is used to facilitate assembly of multi-piece container such as, for example, a container comprising a body panel and left-side and right-side end panels.

One embodiment of a container-assembly apparatus in accordance with the present invention is shown in FIGS. 32 and 33. Apparatus 420 includes a turntable 422 supported for rotation on a support post 424. In the illustrated embodiment, turntable 422 has an octagon shape and four container-assembly jigs 426. Each jig 426 comprises four jig pegs 428 coupled to turntable 422 as shown in FIG. 33. Jig pegs 428 are arranged to lie in, for example, a rectangular pattern, and to extend into four of apertures 37 formed in body panel 14 and into two of apertures 39 formed in each of left-side and right-side end panels 16, 18 as shown in FIG. 3 during assembly of panels 14, 16, and 18 to produce containers. It is within the scope of the present invention to vary the number, size, shape, and arrangement of jig pegs 428 on turntable 422 and to vary the number and location of jig peg-receiving apertures formed in panels 14, 16, 18 or other panels or pieces assembled to form containers. It is also within the scope of the present invention to provide a series of jigs 426 on a movable conveyor belt or the like instead of on a rotating turntable 422.

Four work stations are provided for workers using turntable 422 to assemble containers. At first work station 430, a first worker 431 takes a body panel 14 from a stack of panels 14 and places it on a first jig 426 so that jig pegs 428 fit into locator hole 37 to position the panel 14 properly in a predetermined position on turntable 422. At second work station 432, a second worker 433 applies glue 429 to each end flap 22, 26 included in body panel 14. At third work station 434, a third worker 435 removes two end panels from a stack of end panels and couples one of the panels to the glue-carrying left end flap 22 to produce left-side end panel 16 and couples the other panel to the glue-carrying right end flap 26 to produce right-side end panel 18. At fourth work station 436, a fourth worker 437 removes a completed blank 10 from turntable 422 and places it in a stack of blanks 10 located to one side of apparatus 430. During this process, turntable 422 is rotated manually or automatically in direction 438 to enable the workers to perform their assignments simultaneously. By rotating turntable 422 about support post 424 at a rate of 12–15 revolutions per minute, about 750 containers could be assembled during each fifty-minute period or about 6,000 assembled containers per four-worker shift.

Figure 34:
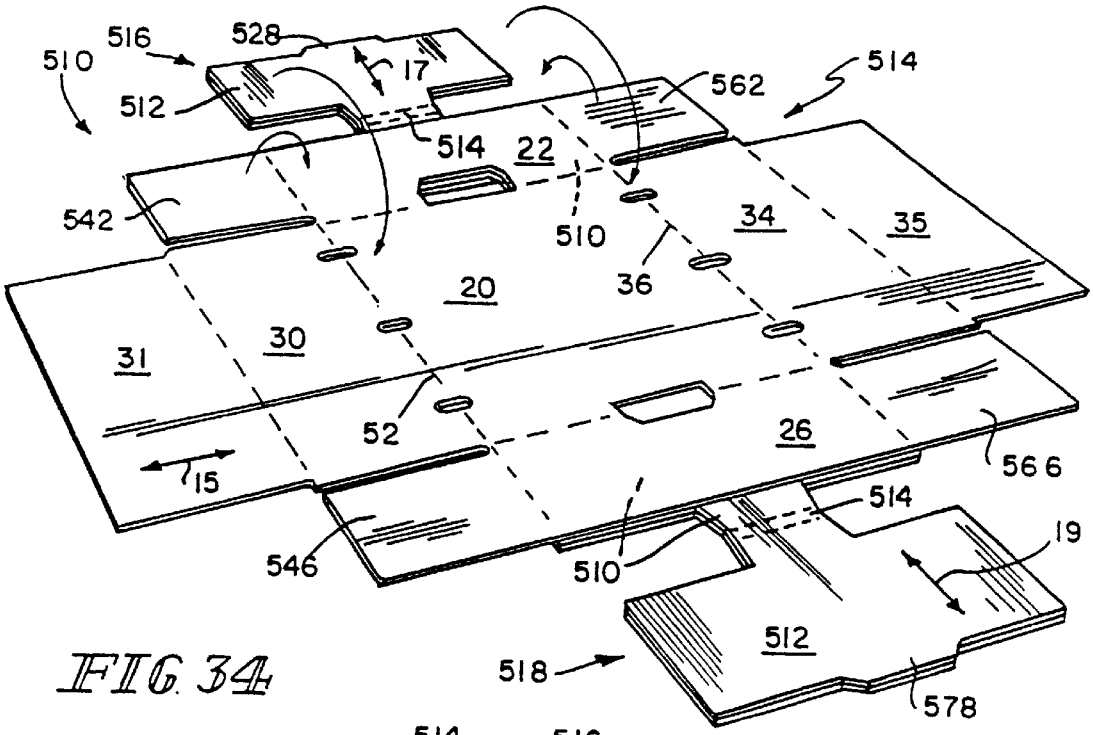
FIG. 34 is a perspective view of a partly assembled three-piece container in accordance with a fifth embodiment of the present invention showing a body including a left end flap, a pair of side wall support flaps appended to the left end flap, a right end flap, and a pair of side wall support flaps appended to the right end flap, a foldable left-side end panel coupled to the left end flap, and a foldable right-side end panel coupled to the right end flap.
Figure 35:
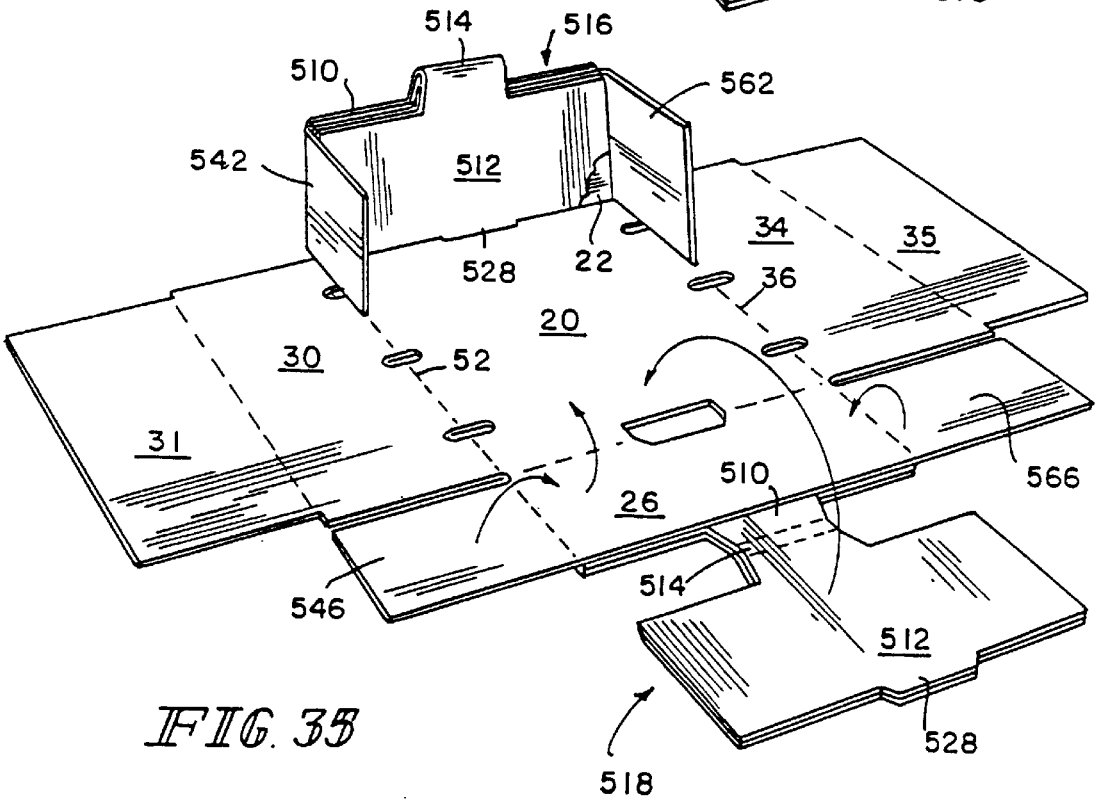
FIG. 35 is a view similar to FIG. 34 showing folding and placement of the side wall support flaps and the end panels during an early stage of container assembly.
Figure 39:
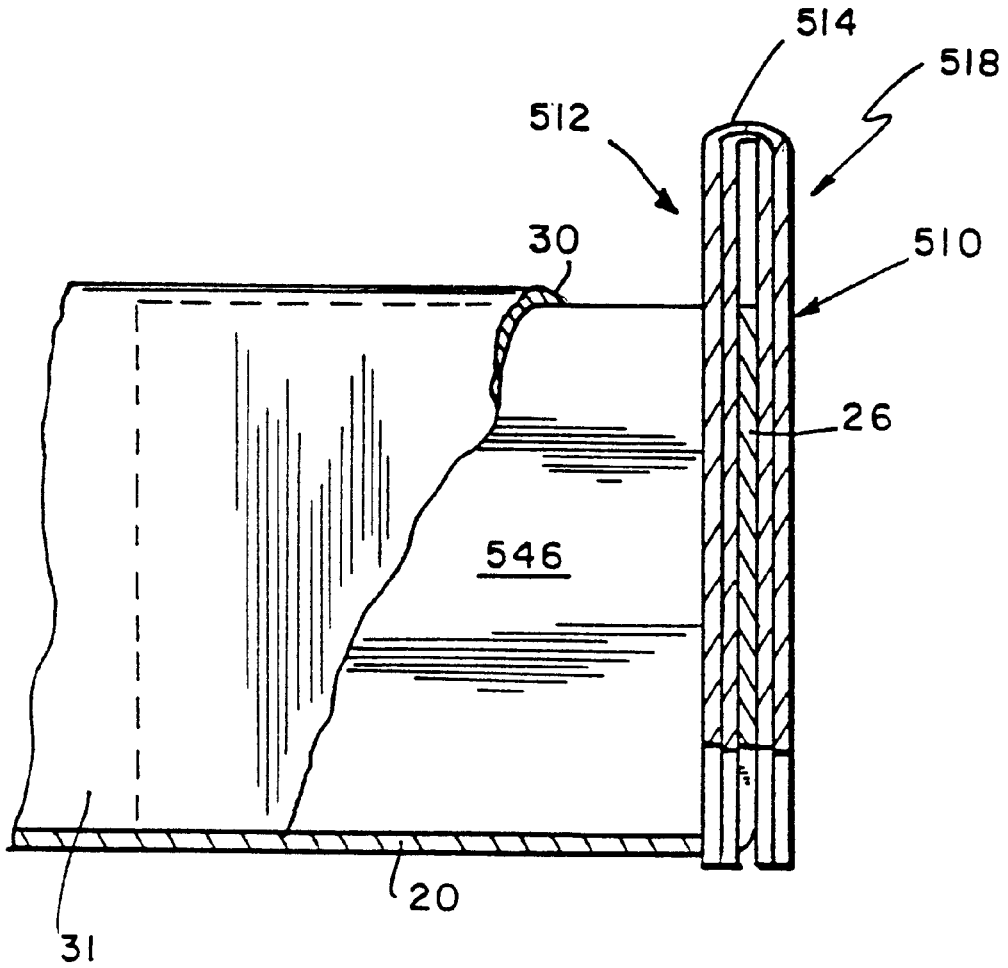
FIG. 39 is a sectional view taken along line 30—30 of FIG. 38.

A fifth embodiment of a container in accordance with the present invention is shown in FIGS. 34–39. In this embodiment, support flaps are appended to left and right end panels 22, 26 as shown in FIG. 34 (instead of being appended to front and rear side walls as shown in connection with other embodiments) and moved to provide support for front and rear side walls as shown in FIGS. 35 and 36 (instead of being moved to provide support for left-side and right-side end panels as shown in connection with other embodiments).

As shown in FIG. 34, body panel 514 includes floor 20, left and right end flaps 22, 26, front and rear side walls 30, 34, an auxiliary front side wall 31 appended to front side wall 30, and an auxiliary rear side wall 35 appended to rear side wall 34. Each of left-side and right-side end panels 516, 518 includes an outer panel section 510, an inner panel section 512, and a top edge section 514 interconnecting sections 510 and 512. Panels 516, 518 can be made of one or more layers of corrugated material or other suitable paperboard material.

First and second side wall support flaps 542 and 562 are appended to opposite ends of left end flap 22 and third and fourth side wall support flaps 546 and 566 are appended to opposite ends of right end flap 26 as shown, for example, in FIG. 34. A friction tab 528 is appended to inner panel section of each of left-side and right-side end panels 516, 518 as shown in FIG. 34.

Assembly of a container using a blank 510 of the type illustrated in FIG. 34 is shown in FIGS. 35–37. Left-side and right-side end panels 516, 518 are folded as shown in FIG. 35 to position side wall support flaps 542, 546 along fold line 52 and to position side wall support flaps 562, 566 along fold line 36. Then rear side walls 34, 35 and front side walls 30, 31 are moved as shown in FIG. 36 to produce container 512 shown in FIG. 37. In container 512, side wall support flaps 542, 546 lie in a pocket defined by front side walls 530, 531 and side wall support flaps 562, 566 lie in a pocket defined by rear side walls 534, 535 as shown, for example, in FIGS. 37–39.

The subject matter disclosed in co-pending U.S. Provisional Patent Application No. 60/058,339 is incorporated by reference herein. The filing date of that application was Sep. 10, 1997.

Although the invention has been described in detail with reference to certain preferred embodiments, variations and modifications exist within the scope and spirit of the invention as described and defined in the following claims.

What is claimed is:

1. A container comprising a body including a floor having two sides and two ends, a front side wall appended to the floor along one side of the floor, a rear side wall appended to the floor along a second side of the floor to lie opposite the front side wall, first and second end panel support flaps appended to the front side wall, third and fourth end panel support flaps appended to the rear side wall, right and left end flaps appended to the floor at each end respectively, and first and second tab receiving apertures extending through the floor adjacent the points of appending of the first and second end panel support flaps respectively, a left-side end panel separately formed from a material unconnected to the body and positioned to lie at one end of the floor between the front and rear side walls and formed to include a left-side pocket receiving the first and third end panel support flaps therein and having at least one stacking tab insertable into the first tab receiving aperture, and a right-side end panel separately formed from a material unconnected to the body and positioned to lie at an opposite end of the floor between the front and rear side walls and formed to include a right-side pocket receiving the second and fourth end panel support flaps therein and having at least one tab insertable into the second aperture.

2. The container of claim 1, wherein the left end flap appended to the floor is positioned to lie between the front and rear side walls and, the left-side end panel is coupled to the left end flap.

3. The container of claim 2, wherein the left-side end panel includes an outer panel section, an inner panel section, and a top edge section interconnecting the outer and inner panel sections and cooperating with the outer and inner panel sections to define the left-side pocket therebetween, and tie outer panel section is coupled to the outer surface of the left end flap.

4. The container of claim 2, wherein right end flap appended to the floor is positioned to lie between the front and rear side walls and opposite the left end flap and the right-side end panel is coupled to the right end flap.

5. The container of claim 4, wherein the front and rear side walls cooperate to define an interior region of the body, each of the left and right end flaps include an inner surface facing into the interior region and an outer surface facing away from the interior region, the left-side end panel is coupled to the outer surface of the left end flap, and the right-side end panel is coupled to the outer surface of the right end flap.

6. The container of claim 5, wherein each of the left-side and right-side end panels include an outer panel section, an inner panel section, and a top edge section interconnecting the outer and inner panel sections and cooperating with the outer and inner panel sections to define one of the left-side and right-side pockets therebetween, the outer panel section of the left-side end panel is coupled to the outer surface of the left end flap and the outer panel section of the right-side end panel is coupled to the outer surface of the right end flap.

7. The container of claim 1, wherein the left-side end panel includes an outer panel section, an inner panel section, and a top edge section interconnecting the outer and inner panel sections and cooperating with the outer and inner panel sections to define the left-side pocket therebetween.

8. The container of claim 7, wherein the inner panel section includes an edge frictionally engaging the floor.

9. The container of claim 7, wherein the outer panel section includes at least one outer stacking tab extending above the top edge section and away from the floor.

10. The container of claim 9, wherein the tab-receiving apertures also extends through the end panel support flaps and at least one of the first and third end panel support flaps includes an inner stacking tab extending through the tab-receiving aperture formed in the left-side end panel and mating with the at least one outer stacking tab included in the outer panel section.

11. The container of claim 7, wherein the right-side end panel includes an outer panel section, an inner panel section, and a top edge section interconnecting the outer and inner panel sections and cooperating with the outer and inner panel sections to define the right-side pocket therebetween.

12. The container of claim 11, wherein the inner panel section of each of the left-side and right-side end panels includes an edge frictionally engaging the floor.

13. The container of claim 11, wherein the outer panel section of each of the left-side and right-side end panels includes at least one outer stacking tab extending away from the floor.

14. The container of claim 1, wherein the left-side end panel is formed to include first and second outer stacking tabs and a stacking tab-receiving aperture adjacent to the first and second outer stacking tabs, the first end panel support flap includes an inner stacking tab extending through the stacking tab-receiving aperture and aligning with the first outer stacking tab, and the second end panel support flap includes an inner stacking tab extending through the stacking tab-receiving aperture and aligning with the second outer stacking tab.

15. The container of claim 14, wherein each of the inner stacking tabs is formed to include a lid-receiving slot, the body further includes a first lid section appended to the front side wall and a second lid section appended to the rear side wall, a portion of the first lid section fits into the lid-receiving slot formed in one of the inner stacking tabs, and a portion of the second lid section fits into the lid-receiving slot formed in another of the inner stacking tabs.

16. The container of claim 14, wherein the left-side end panel includes a border edge defining the stacking tab-receiving aperture, the inner stacking tab of the first end panel support flap is positioned to lie adjacent to a portion of the border edge, and the inner stacking tab of the third end panel support flap is positioned to lie adjacent to another portion of the border edge.

17. The container of claim 16, wherein each inner stacking tab and each of the first and second outer stacking tabs is formed to include a lid-receiving slot and the body further includes a first lid section appended to the front side wall and engaged in the lid-receiving slots of the first outer stacking tab and the inner stacking tab of the first panel support wall and a second lid section appended to the rear side wall and engaged in the lid-receiving slots of the second outer stacking tab and the inner stacking tab of the second panel support wall.

18. The container of claim 14, wherein the first tab-receiving aperture is configured to receive stacking tabs included in an underlying container.

19. The container of claim 1, wherein each of the first and third end panel support flaps is positioned to lie perpendicular to the front side wall and each of the second and fourth end panel support flaps is positioned to lie perpendicular to the rear side wall.

20. The container of claim 19, wherein the first and third end panel support flaps are aligned to lie in coplanar relation.

21. The container of claim 20, wherein the second and fourth end panel support flaps are aligned to lie in coplanar relation.

22. The container of claim 20, wherein the body further includes a left end flap appended to the floor and coupled to the left-side end panel and the left end flap is positioned to lie in parallel relation to the first and third end panel support flaps.

23. The container of claim 22, wherein the left end flap is positioned to lie between the outer-panel section of the left-side end panel and the first and third panel support walls.

24. The container of claim 23, wherein the outer panel section of the left-side end panel is coupled to the left end flap.

25. The container of claim 1, wherein the left-side end panel includes an outer panel section, an inner panel section, a top edge section interconnecting the outer and inner panel sections and cooperating with the outer and inner panel sections to define the left-side pocket therebetween, and a first pair of tabs appended to the inner panel section, and each tab in the first pair of tabs is coupled to one of the front and rear side walls.

26. The container of claim 25, wherein the inner panel section includes opposite ends and each tab in the first pair of tabs includes an edge appended to one of the opposite ends.

27. The container of claim 25, wherein the left-side end panel further includes a second pair of tabs appended to the outer panel section and each tab in the second pair of tabs is positioned to lie in a space between the outer panel section and one of the first and third end panel support flaps.

28. The container of claim 27, wherein the outer panel section includes opposite ends and each tab in the second pair of tabs includes an edge appended to one of the opposite ends of the outer panel section.

29. A container comprising a body including opposite front and rear side walls, opposite left and right end flaps, a floor appended to each of the front side wall, rear side wall, left end flap, and right end flap, a first end panel support flap appended to the front side wall and arranged to extend toward the rear side wall alongside the left end flap, a second end panel support flap appended to the front side wall and arranged to extend toward the rear side wall alongside the right end flap, a third end panel support flap appended to the rear side wall and arranged to extend toward the front side wall alongside the left end flap, a fourth end panel support flap appended to the rear side wall and arranged to extend toward the front side wall alongside the right end flap, and tab receiving apertures extending through the floor adjacent the points of appending of the floor and panel support flaps, a left-side end panel separately formed from a material unconnected to the body and coupled to the left end flap and positioned to lie between the front and rear side walls, the left-side end panel including an outer panel section and an inner panel section cooperating with the outer panel section of the left-side end panel to trap the first and third end panel support flaps therebetween, the inner panel section having at least one stacking tab insertable into one of the tab receiving apertures, and a right-side end panel separately formed from a material unconnected to the body and coupled to the right end flap and positioned to lie between the front and rear side walls, the left-side end panel including an outer panel section and an inner panel section cooperating with the outer panel section of the right-side end panel to trap the second and fourth end panel support flaps therebetween, the inner panel section having at least one stacking tab insertable into one of the tab receiving apertures.

30. The container of claim 29, wherein each of the first and third end panel support flaps is positioned to lie perpendicular to the front side wall and each of the second and fourth end panel support flaps is positioned to lie perpendicular to the rear side wall.

31. The container of claim 30, wherein the first and third end panel support flaps are aligned to lie in coplanar relation.

32. The container of claim 31, wherein the second and fourth end panel support flaps are aligned to lie in coplanar relation.

33. The container of claim 30, wherein the left end flap is positioned to lie in spaced-apart parallel relation to the first and third end panel support flaps.

34. The container of claim 33, wherein the outer panel section of the left-side end panel is positioned to lie between the left end flap and the first and third end panel support flaps.

35. The container of claim 30, wherein the left end flap is positioned to lie in parallel relation to the first and third end panel support flaps and the right end flap is positioned to lie in parallel relation to the second and fourth end panel support flaps.

36. The container of claim 35, wherein the outer panel section of the left-side end panel is positioned to lie between the left end flap and the first and third end panel support flaps and the outer panel section of the right-side end panel is positioned to lie between the right end flap and the second and fourth end panel support flaps.

37. The container of claim 36, wherein the outer panel section of the left-side end panel is coupled to the left end flap and the outer panel section of the right-side end panel is coupled to the right end flap.

38. The container of claim 35, wherein the left end flap is positioned to lie between the outer panel section of the left-side end panel and the first and third panel support walls and the right end flap is positioned to lie between the outer panel section of the right-side end panel and the second and fourth panel support walls.

39. The container of claim 38, wherein the outer panel section of the left-side end panel is coupled to the left end flap and the outer panel section of the right-side end panel is coupled to the right end flap.

40. The container of claim 29, wherein the left-side end panel further includes a first pair of tabs appended to opposite ends of the inner panel section of the left-side end panel.

41. The container of claim 40, wherein each tab in the first pair of tabs is positioned to lie in a space between the inner panel section and one of the first and third end panel support flaps.

42. The container of claim 41, wherein the left-side end panel further includes a second pair of tabs appended to the outer panel section and each tab in the second pair of tabs is positioned to lie in a space between the outer panel section and one of the first and third end panel support flaps.

43. The container of claim 40, wherein each tab in the first pair of tabs is coupled to one of the front and rear side walls.

44. The container of claim 43, wherein the left-side end panel further includes a second pair of tabs appended to the outer panel section and each tab in the second pair of tabs is positioned to lie in a space between the outer panel section and one of the first and third end panel support flaps.

45. A container comprising a body including a floor, a front side wall appended to the floor, a rear side wall appended to the floor to lie opposite the front side wall, a left end flap appended to the floor a first end panel support flap appended to the front side wall, and a second end panel support flap appended to the rear side wall, an end panel separately formed from a material unconnected to the body and positioned to lie at one end of the floor between the front and rear side walls and formed to include a pocket receiving the left end flap and the first and second end panel support flaps therein, and wherein the floor includes at least one aperture therein, which aperture receives a tab located on the end panel.

46. The container of claim 45, wherein the left end flap is positioned to lie between the front and rear side walls and the end panel is coupled to the end flap.

47. The container of claim 46, wherein the front and rear side walls cooperate to define an interior region of the body, the end flap includes an inner surface facing into the interior region and an outer surface facing away from the interior region, and the end panel is coupled to the outer surface of the end flap.

48. The container of claim 47, wherein the end panel includes an outer panel section, an inner panel section, and a top edge section interconnecting the outer and inner panel sections and cooperating with the outer and inner panel sections to define the pocket therebetween, and the outer panel section is coupled to the outer surface of the end flap.

49. The container of claim 45, wherein the end panel includes an outer panel section, an inner panel section, and a top edge section interconnecting the outer and inner panel sections and cooperating with the outer and inner panel sections to define the pocket therebetween.

50. The container of claim 49, wherein the inner panel section includes the tab which has an edge that frictionally engages an edge of the aperture.

51. The container of claim 49, wherein the outer panel section includes at least one outer stacking tab extending above the top edge section and away from the floor.

52. The container of claim 51, wherein the aperture also extends through the and at least one of the first and second end panel support flaps includes an inner stacking tab extending through the tab-receiving aperture formed in the end panel and mating with the at least one outer stacking tab included in the outer panel section.

53. The container of claim 45, wherein the first end panel support flap is positioned to lie perpendicular to the front side wall and the second end panel support flap is positioned to lie perpendicular to the rear side wall.

54. The container of claim 53, wherein the first and second end panel support flaps are aligned to lie in coplanar relation.

55. A container comprising a body including a floor, a front side wall appended to the floor, a rear side wall appended to the floor to lie opposite the front side wall, first and second end panel support flaps appended to the front side wall, and third and fourth end panel support flaps appended to the rear side wall, a left-side end panel separately formed from a material unconnected to the body and positioned to lie at one end of the floor between the front and rear side walls, the left-side end panel including an outer panel section, an inner panel section, and a top edge section interconnecting the outer and inner panel sections, the outer and inner panel sections cooperating to define a left-side pocket receiving the first and third end panel support flaps therein, and a right-side end panel separately formed from a material unconnected to the body and positioned to lie at an opposite end of the floor between the front and rear side walls, the right-side end panel including an outer panel section, an inner panel section, and a top edge section interconnecting the outer and inner panel sections, the outer and inner panel sections cooperating to define a right-side pocket receiving the second and fourth end panel support flaps therein, and wherein the body further includes at least one aperture at one end thereof and a left end flap appended to the floor at the location of the aperture and positioned to lie between the front and rear side walls and the outer panel section of the left-side end panel is coupled to the left end flap and the inner panel section of the left-side end panel is provided with a tab that extends into the aperture.

56. The container of claim 55, wherein each of the first and third end panel support flaps is positioned to lie between the left end flap and the inner panel section of the left-side end panel.

57. The container of claim 55, wherein the body further includes a right end flap appended to the floor and positioned to lie between the front and rear side walls and opposite the left end flap and the outer panel section of the right-side end panel is coupled to the right end flap.

58. The container of claim 57, wherein each of the second and fourth end panels is positioned to lie between the right end flap and the inner panel section of the right-side end panel.

59. The container of claim 58, wherein each of the first and third end panel support flaps is positioned to lie between the left end flap and the inner panel section of the left-side end panel.

60. The container of claim 57, wherein the front and rear side walls cooperate to define an interior region of the body, each of the left and right end flaps include an inner surface facing into the interior region and an outer surface facing away from the interior region, the outer panel section of the left-side end panel is coupled to the outer surface of the left end flap, and the outer panel section of the right-side end panel is coupled to the outer surface of the right end flap.

61. The container of claim 60, wherein each of the first and third end panel support flaps is positioned to lie between the outer surface of the inner panel section of the left-side end panel and the left end flap and each of the second and fourth end panel support flaps is positioned to lie between the outer surface of the inner panel section of the right-side end panel and the right end flap.

62. The container of claim 55, wherein each of the first and third end panel support flaps is positioned to lie perpendicular to the front side wall and between the left end flap and the inner panel section of the left-side end panel and each of the second and fourth end panel support flaps is positioned to lie perpendicular to the rear side wall and between the right end flap and the inner panel section of the right-side end panel.

63. The container of claim 62, wherein the first and third end panel support flaps are aligned to lie in coplanar relation and the second and fourth end panel support flaps are aligned to lie in coplanar relation.

64. The container of claim 55, wherein the inner panel section of each of the left-side and right-side end panels includes an edge frictionally engaging the floor.

65. The container of claim 55, wherein the outer panel section of each of the left-side and right-side end panels includes at least one outer stacking tab extending above the top edge section and away from the floor.

66. The container of claim 65, wherein the left-side end panel is formed to include a tab-receiving aperture adjacent to the at least one outer stacking tab and at least one of the first and third end panel support flaps includes an inner stacking tab extending through the tab-receiving aperture formed in the left-side end panel and mating with the at least one outer stacking tab included in the outer panel section of the left-side end panel.

* * * * *